US009914317B2

(12) United States Patent
Fukunaga et al.

(10) Patent No.: US 9,914,317 B2
(45) Date of Patent: Mar. 13, 2018

(54) HEAT-SENSITIVE TRANSFER RECORDING MEDIUM

(71) Applicant: TOPPAN PRINTING CO., LTD., Tokyo (JP)

(72) Inventors: Godai Fukunaga, Tokyo (JP); Yasunori Ono, Tokyo (JP); Takehito Yamato, Tokyo (JP); Yasuhiro Miyauchi, Tokyo (JP); Yoko Hirai, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 0 days.

(21) Appl. No.: 15/278,953

(22) Filed: Sep. 28, 2016

(65) Prior Publication Data

US 2017/0015126 A1 Jan. 19, 2017

Related U.S. Application Data

(60) Division of application No. 14/605,535, filed on Jan. 26, 2015, which is a continuation of application No. PCT/JP2013/005314, filed on Sep. 6, 2013.

(30) Foreign Application Priority Data

| | | |
|---|---|---|
| Sep. 11, 2012 | (JP) | 2012-199639 |
| Sep. 25, 2012 | (JP) | 2012-211049 |
| Sep. 26, 2012 | (JP) | 2012-212883 |
| Nov. 12, 2012 | (JP) | 2012-248141 |
| Dec. 4, 2012 | (JP) | 2012-265483 |

(51) Int. Cl.
*B41M 5/382* (2006.01)
*B41M 5/44* (2006.01)
(Continued)

(52) U.S. Cl.
CPC ..... *B41M 5/443* (2013.01); *B41M 5/38214* (2013.01); *B41M 5/395* (2013.01);
(Continued)

(58) Field of Classification Search
CPC .... B41M 5/382; B41M 5/38214; B41M 5/42; B41M 5/426; B41M 5/44; B41M 5/443;
(Continued)

(56) References Cited

U.S. PATENT DOCUMENTS 4,895,830 A 1/1990 Takeda et al.
5,494,885 A 2/1996 Kudo et al.
(Continued)

FOREIGN PATENT DOCUMENTS

EP 0 951 991 A1 10/1999
JP 02-057389 A 2/1990
(Continued)

OTHER PUBLICATIONS

International Search Report dated Dec. 3, 2013 issued in Application No. PCT/JP2013/005314.
(Continued)

*Primary Examiner* — Bruce H Hess
(74) *Attorney, Agent, or Firm* — Foley & Lardner LLP

(57) ABSTRACT

There is provided a heat-sensitive transfer recording medium which is able to better suppress the occurrence of abnormal transfer during high-speed printing using a high-speed printer of sublimation transfer type and is able to improve transfer sensitivity in high-speed printing. The heat-sensitive transfer recording medium includes a base (10), a heat-resistant lubricating layer (20) formed on one surface of the base (10), an underlying layer (30) formed on the other surface of the base (10), and a dye layer (40) formed on a surface of the underlying layer (30), which is on the other side of a surface facing the base (10). In the heat-sensitive transfer recording medium, the underlying layer (30) has a major component that is a copolymer of polyester having a sulfonic group on a side chain and acrylic having at least one of a glycidyl group and a carboxyl group.

5 Claims, 1 Drawing Sheet

(51) Int. Cl.
*B41M 7/00* (2006.01)
*B41M 5/42* (2006.01)
*B41M 5/395* (2006.01)

(52) U.S. Cl.
CPC ..... *B41M 5/42* (2013.01); *B41M 5/426* (2013.01); *B41M 5/44* (2013.01); *B41M 7/0027* (2013.01); *B41M 2205/02* (2013.01); *B41M 2205/30* (2013.01); *B41M 2205/36* (2013.01); *B41M 2205/38* (2013.01); *B41M 2205/40* (2013.01)

(58) Field of Classification Search
CPC .. B41M 7/00; B41M 7/0027; B41M 2205/02; B41M 2205/30; B41M 2205/38; B41M 2205/40
USPC ..... 503/227; 428/32.77, 32.81
See application file for complete search history.

(56) References Cited

U.S. PATENT DOCUMENTS

| | | | |
|---|---|---|---|
| 5,773,126 | A | 6/1998 | Noritake et al. |
| 5,841,462 | A | 11/1998 | Matsuo et al. |
| 2002/0110692 | A1 | 8/2002 | Suzuki |
| 2010/0196631 | A1 | 8/2010 | Sawada |

FOREIGN PATENT DOCUMENTS

| | | | |
|---|---|---|---|
| JP | 02-145394 | A | 6/1990 |
| JP | 03-065395 | A | 3/1991 |
| JP | 07-276831 | A | 10/1995 |
| JP | 08-011447 | A | 1/1996 |
| JP | 08-067074 | A | 3/1996 |
| JP | 08-188661 | A | 7/1996 |
| JP | 10-044626 | A | 2/1998 |
| JP | 2000-272257 | A | 10/2000 |
| JP | 2002-127620 | A | 5/2002 |
| JP | 2002-156505 | A | 5/2002 |
| JP | 2003-312151 | A | 11/2003 |
| JP | 2005-231354 | A | 9/2005 |
| JP | 2006-150956 | A | 6/2006 |
| JP | 2007-084670 | A | 4/2007 |
| JP | 2010-179523 | A | 8/2010 |

OTHER PUBLICATIONS

Partial Supplementary European Search Report issued in corresponding EP Application No. 13836402 dated Mar. 10, 2016.

HEAT-SENSITIVE TRANSFER RECORDING MEDIUM

CROSS-REFERENCE TO RELATED PATENT APPLICATIONS

This application is a divisional of U.S. patent application Ser. No. 14/605,535 filed on Jan. 26, 2015, which is a continuation application filed under 35 U.S.C. § 111(a) claiming the benefit under 35 U.S.C. § § 120 and 365(c) of PCT International Application No. PCT/JP2013/005314 filed on Sep. 6, 2013, which is based upon and claims the benefit of priority of Japanese Application No. 2012-199639 filed on Sep. 11, 2012; Japanese Application No. 2012-211049 filed on Sep. 25, 2012; Japanese Application No. 2012-212883 filed on Sep. 26, 2012; Japanese Application No. 2012-248141 filed on Nov. 12, 2012; and Japanese Application No. 2012-265483 filed on Dec. 4, 2012, the entire contents of which are hereby incorporated by reference in their entireties.

BACKGROUND

Technical Field

The present invention relates to a heat-sensitive transfer recording medium used for a heat-sensitive transfer type printer.

Background Art

Heat-sensitive transfer recording media, which are generally used in many cases in the form of ink ribbons in heat-transfer type printers, are also called thermal ribbons. Such a heat-sensitive transfer recording medium has a structure that includes a base having one surface provided with a heat-sensitive transfer layer and the other surface provided with a heat-resistant lubricating layer (back coat layer). The heat-sensitive transfer layer is a layer of an ink, and the ink of the layer is transferred to an object by sublimation (sublimation transfer method) or melting (melt transfer method) by means of heat generated at a thermal head of a printer.

Of these methods, the sublimation transfer method enables relatively easy full-color formation of various images in combination with a sophisticated printer and thus has been widely used such as for self-prints of digital cameras, cards such as for identification, or output materials for amusement. As the usage of the heat-sensitive transfer recording media is diversified, there arises an increasing need for the media to reduce size, increase speed, reduce cost or enhance durability of the obtained printed materials. For this reason, predominantly prevailing heat-sensitive transfer recording media of recent years include a plurality of heat-sensitive transfer layers which are provided on one surface of a base sheet so as not to be overlaid such as on a protective layer that imparts durability to the photo prints.

Under such circumstances, as printing speed of printers is increasing in association with the diversified and predominantly prevailing usage of heat-sensitive transfer recording media, there arises a problem that the heat-sensitive transfer recording media of the conventional art cannot achieve a sufficient print density. In order to enhance the transfer sensitivity in printing, an attempt has been made to reduce the thickness of such a heat-sensitive transfer recording medium. However, this leads to a problem of causing wrinkles or sometimes a problem of being torn due to the heat, pressure or the like in manufacturing the heat-sensitive transfer recording media or in performing printing using the heat-sensitive transfer recording medium.

Further, in another attempt that has been made, the ratio of dye/binder is increased in the dye layer of a heat-sensitive transfer recording medium to enhance the print density and the transfer sensitivity in printing. However, the increase of dye raises not only a problem of increasing cost, but also a problem of partial transition (offset) of the dye into the heat-resistant lubricating layer of the heat-sensitive transfer recording medium in a state of being taken up in the course of the manufacture. When the heat-sensitive transfer recording medium is rolled again, the dye that has transitioned into the heat-resistant lubricating layer again transitions into a dye layer of a different color or into a protective layer (re-offset). If the smudged layers are heat-transferred to an object to be transferred, the resultant hue may be different from a specified color, or may cause so-called scumming.

Further, in still another attempt that has been made, energy in forming an image is increased on a printer side, not on a heat-sensitive transfer recording medium side. However, in this case, power consumption is increased. In addition, the load imposed on a thermal head of the printer is increased and thus the life of the thermal head is shortened. Further, increase of the load tends to cause uneven thermal conduction of the thermal head and uneven color development in printing, or transfer failure of the heat transferable protective layer. In addition to that, increase of the load tends to cause so-called abnormal transfer that is a fusion between the dye layer and an object to be transferred. In order to prevent the occurrence of the abnormal transfer, the adhesiveness between the base and the dye layer is required to be enhanced. For the purpose of enhancing the adhesiveness between the base and the dye layer, some measures have been taken, such as using a base given an easy-adhesion treatment or providing an adhesive layer (underlying layer) on the base.

The easy-adhesion treatment includes, for example, corona treatment, flame treatment, ozone treatment, ultraviolet treatment, radiation treatment, rough surface treatment, plasma treatment or primer treatment. However, although use of a base given the easy-adhesion treatment can ensure adhesiveness, use of such a base raises a problem of incurring high cost in obtaining the base and of not ensuring sufficient print density.

In order to solve such a problem, for example, Patent Literature 1 or 2 proposes to provide a heat transfer sheet between a base and a dye layer, the heat transfer sheet having an adhesive layer (underlying layer) that contains a polyvinylpyrrolidone resin and a modified polyvinylpyrrolidone resin.

Further, in order to solve the insufficient transfer sensitivity, Patent Literature 3 proposes a heat transfer sheet having an underlying layer which is comprised of polyvinylpyrrolidone/polyvinyl alcohol and colloidal inorganic pigment fine particles.

CITATION LIST

Patent Literature 1: JP-A-2003-312151
Patent Literature 2: JP-A-2005-231354
Patent Literature 3: JP-A-2006-150956

SUMMARY OF THE INVENTION

Technical Problem

However, when printing was performed using an existing high-speed printer of a sublimation transfer type and using the heat-sensitive transfer recording medium proposed in Patent Literature 1 or 2, the transfer sensitivity was low in the print, not reaching a sufficient level, although no abnormal transfer was observed.

Further, when printing was performed using a high-speed printer of sublimation transfer type and using the heat-sensitive transfer recording medium proposed in Patent Literature 3, an abnormal transfer was observed, although the transfer sensitivity was high, reaching a sufficient level.

Thus, in the conventional art, no heat-sensitive transfer recording medium that satisfies both of prevention of abnormal transfer and high transfer sensitivity has been developed, for use in a high-speed printer of sublimation transfer type.

The present invention has been made in light of the problems set forth above and has as its object to provide a heat-sensitive transfer recording medium which is able to better suppress the occurrence of the abnormal transfer and enhance transfer sensitivity in the print in the case where high-speed printing is performed using a high-speed printer of sublimation transfer type (i.e. in the case where printing is performed by increasing energy applied to the thermal head of the printer).

Solution to Problem

In order to solve the above problems, a heat-sensitive transfer recording medium related to an aspect of the present invention includes a base; a heat-resistant lubricating layer formed on one surface of the base; an underlying layer formed on the other surface of the base; and a dye layer formed on a surface of the underlying layer, the surface being on the other side of a surface facing the base, in which the underlying layer has a major component that is a copolymer of polyester having a sulfonic group on a side chain and acrylic having at least one of a glycidyl group and a carboxyl group.

Preferably, in the heat-sensitive transfer recording medium related to the aspect of the present invention, a copolymerization ratio of the polyester and the acrylic is in a range of not less than about 20:80 to not more than about 40:60 in terms of weight ratio.

Preferably, in the heat-sensitive transfer recording medium related to the aspect of the present invention, a dry coating amount of the underlying layer is in a range of not less than about 0.05 g/m$^2$ to not more than about 0.30 g/m$^2$.

A heat-sensitive transfer recording medium related to another aspect of the present invention includes a base; a heat-resistant lubricating layer formed on one surface of the base; an underlying layer formed on the other surface of the base; and a dye layer formed on a surface of the underlying layer, the surface being on the other side of a surface facing the base, in which: the dye layer contains at least a dye, a resin and a release agent; the release agent is non-reactive polyether-modified silicone having a viscosity of not less than about 800 mm$^2$/s at 25° C., and an HLB value of not more than about 10; and the non-reactive polyether-modified silicone is contained in the dye layer within an amount ranging from not less than about 0.5 wt % to not more than about 10 wt % relative to the resin.

Preferably, in the heat-sensitive transfer recording medium related to the aspect of the present invention, the dye layer contains at least a dye, a resin and a release agent; the release agent is non-reactive polyether-modified silicone having a viscosity of not less than about 800 mm$^2$/s at 25° C., and an HLB value of not more than about 10; and the non-reactive polyether-modified silicone is contained in the dye layer within an amount ranging from not less than about 0.5 wt % to not more than about 10 wt % relative to the resin.

Preferably, in the heat-sensitive transfer recording medium related to the aspect of the present invention, a dry coating amount of the underlying layer is in a range of not less than about 0.05 g/m$^2$ to not more than about 0.30 g/m$^2$.

Preferably, in the heat-sensitive transfer recording medium related to the aspect of the present invention, the dye layer is formed containing polyvinyl acetal resin having a glass-transition temperature of not less than about 100° C. and polyvinyl butyral resin having a glass-transition temperature of not more than about 75° C.

Preferably, in the heat-sensitive transfer recording medium related to the aspect of the present invention, a content ratio of the polyvinyl acetal resin having a glass-transition temperature of not less than about 100° C. and the polyvinyl butyral resin having a glass-transition temperature of not more than about 75° C. is in a range of 97:3 to 50:50.

A heat-sensitive transfer recording medium related to another aspect of the present invention includes a base; a heat-resistant lubricating layer formed on one surface of the base; and a dye layer formed on the other surface of the base, in which: the heat-resistant lubricating layer contains at least a binder comprised of a thermoplastic resin or a reactant of a thermoplastic resin and a polyisocyanate, an inorganic material having cleavage, and spherical particles; a ratio of a true specific gravity of the inorganic material and a true specific gravity of the binder is in a range of not less than about 2.1 to not more than about 3; a ratio of a true specific gravity of the spherical particles and a true specific gravity of the binder is not more than about 1.4; and a ratio of an average particle size of the spherical particles and a thickness of the heat-resistant lubricating layer is in a range of not less than about 0.4 folds to not more than about 2 folds.

Preferably, in the heat-sensitive transfer recording medium related to the aspect of the present invention, a content of the inorganic material is in a range of not less than about 2 mass % to not more than about 10 mass %.

Preferably, in the heat-sensitive transfer recording medium related to the aspect of the present invention, a content of the spherical particles is in a range of not less than about 0.5 mass % to not more than about 2 mass %.

Preferably, in the heat-sensitive transfer recording medium related to the aspect of the present invention, the inorganic material is an inorganic material having a perfect cleavage in one direction.

Preferably, the heat-sensitive transfer recording medium related to the aspect of the present invention includes a heat transferable protective layer in at least a part on a base, and a release layer that turns to an outermost layer after transfer of the heat transferable protective layer, contains polymethylmethacrylate resin by not less than about 95% in terms of solid weight ratio, inorganic fine particles by not less than about 1.0% in terms of solid weight ratio, with an average particle size of not more than about 100 nm, a refractive index of not less than about 1.4 but not more than about 1.6 and a Mohs hardness of not less than about 4, and polyether-modified silicone oil by not less than about 0.5% in terms of solid weight ratio.

Preferably, in the heat-sensitive transfer recording medium related to the aspect of the present invention, the heat transferable protective layer is formed of a plurality of layers of two or more.

Preferably, in the heat-sensitive transfer recording medium related to the aspect of the present invention, the inorganic fine particles are anhydrous silica.

Preferably, in the heat-sensitive transfer recording medium related to the aspect of the present invention, the polyether-modified silicone oil with a solid content of 100% has a kinetic viscosity of not less than about 200 $mm^2/s$ at 25° C.

Preferably, in the heat-sensitive transfer recording medium related to the aspect of the present invention, a release layer that turns to an outermost layer after transfer of the heat transferable protective layer has a dry coating thickness in a range of not less than about 0.5 μm to not more than about 1.5 μm.

Advantageous Effects of the Invention

A heat-sensitive transfer recording medium related to an aspect of the present invention includes an underlying layer that uses a copolymer as a major component, the copolymer being of polyester having a sulfonic group on a side chain and acrylic having at least one of a glycidyl group and a carboxyl group. Thus, under the condition that high-speed printing is performed with the increase of the energy applied to the thermal head of a high-speed printer of sublimation transfer type, the adhesion between the underlying layer and a dye layer is prevented from being lowered in the high-speed printing. Accordingly, the heat-sensitive transfer recording medium is able to suppress the occurrence of an abnormal transfer and improve transfer sensitivity in high-speed printing.

DETAILED DESCRIPTION

First Embodiment

With reference to the drawings, hereinafter are described embodiments of the present invention (hereinafter each referred to as "the present embodiment"), which is to be understood as one representative embodiment of the present invention. The present invention should not be construed as being limited to any of the following examples.

(General Configuration)

Figure 1:
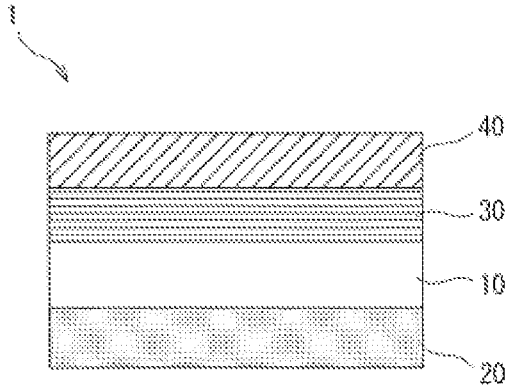
FIG. 1 is a diagram illustrating a schematic configuration of a heat-sensitive transfer recording medium of a first, second and third embodiments of the present invention.

FIG. 1 is a diagram illustrating a schematic configuration of a heat-sensitive transfer recording medium of the present embodiment, the diagram being a cross-section view of the heat-sensitive transfer recording medium as viewed from a lateral side.

As shown in FIG. 1, a heat-sensitive transfer recording medium 1 includes a base 10, a heat-resistant lubricating layer 20, an underlying layer 30 and a dye layer 40.

(Configuration of Base 10)

The base 10 is a member that is required to have heat resistance and strength, which do not allow softening and deformation by the application of a thermal pressure during heat transfer.

The base 10 that can be used is constituted, for example, of: a synthetic resin film such as of polyethylene terephthalate, polyethylene naphthalate, polypropylene, cellophane, acetate, polycarbonate, polysulphone, polyimide, polyvinyl alcohol, aromatic polyamide, aramid or polystylene; or paper, such as condenser paper or paraffin paper. These films or papers are used singly or in combination as a composite.

Among them, the polyethylene terephthalate film is preferable in particular as a material of the base 10, particularly taking account such as of the physical properties, processability or cost.

When operability or processability is concerned, the base 10 can have a thickness within a range of not less than about 2 μm to not more than about 50 μm. However, when handleability, such as transferability or processability, is concerned, a thickness of about not less than about 2 μm but not more than about 9 μm is preferred.

(Configuration of Heat-Resistant Lubricating Layer 20)

The heat-resistant lubricating layer 20 is formed on one surface of the base 10 (lower surface in FIG. 1).

Further, the heat-resistant lubricating layer 20 can be formed using publicly-known materials. For example, the heat-resistant lubricating layer 20 can be formed by blending a resin serving as a binder (binder resin), a functional additive for imparting releasability or lubricity, a filler, a curative, a solvent, and the like to prepare a coating solution for forming the heat-resistant lubricating layer, followed by coating and drying.

Further, a proper dry coating amount of the heat-resistant lubricating layer 20 is about not less than about 0.1 $g/m^2$ but not more than about 2.0 $g/m^2$.

The dry coating amount of the dry heat-resistant lubricating layer 20 refers to a solid content that has remained after coating and drying a coating solution for forming the heat-resistant lubricating layer. Similarly, the dry coating amount of the underlying layer 30 and the dry coating amount of the dye layer 40 each refer to the solid content that has remained after coating and drying the coating solution.

Further, of the materials that form the heat-resistant lubricating layer 20, the binder resin used can include a polyvinyl butyral resin, polyvinyl acetoacetal resin, polyester resin, vinyl chloride-vinyl acetate copolymer, polyether resin, polybutadiene resin, acrylic polyol, polyurethane acrylate, polyester acrylate, polyether acrylate, epoxy acrylate, nitrocellulose resin, cellulose acetate resin, polyamide resin, polyimide resin, polyamide-imide resin or polycarbonate resin.

Of the materials forming the heat-resistant lubricating layer 20, the functional additive used can include a surfactant: such as of a natural wax including an animal series wax, or a plant series wax; a synthetic wax including a synthetic hydrocarbon series wax, an aliphatic alcohol and acid series wax, an aliphatic ester and glycerite series wax, a synthetic ketone series wax, an amine- and amide series wax, a chlorinated hydrocarbon series wax, or an alpha olefin series wax; a higher fatty acid ester including butyl stearate, or ethyl oleate; a higher fatty acid metallic salt including sodium stearate, zinc stearate, calcium stearate, kalium stearate, or magnesium stearate; phosphate ester including long chain alkyl phosphate ester, polyoxyalkylene alkylaryl ether phosphate ester, or polyoxyalkylene alkyl ether phosphate ester.

Of the materials forming the heat-resistant lubricating layer 20, the filler used can include talc, silica, magnesium oxide, zinc oxide, calcium carbonate, magnesium carbonate, kaolin, clay, silicone particles, polyethylene resin particles, polypropylene resin particles, polystyrene resin particles, polymethylmethacrylate resin particles, or polyurthane resin particles.

Further, of the materials forming the heat-resistant lubricating layer 20, the curative used can include isocyanates, such as tolylene diisocyanate, triphenylmethane triisocyanate, and tetramethyl xylene diisocyanate, and derivatives of these materials.

It should be noted that the constitutions of the binder resin, the functional additive, the filler and the curative should not be construed as being limited to the ones mentioned above.

(Configuration of Underlying Layer 30)

The underlying layer is formed on the other surface of the base 10 (upper surface in FIG. 1). Specifically, the underlying layer 30 is formed on a surface of the base 10 opposite to the surface on which the heat-resistant lubricating layer 20 is formed. The underlying layer 30 and the heat-resistant lubricating layer 20 are opposed to each other being interposed by the base 10.

The underlying layer 30 is required to have adhesiveness with the base 10 and the dye layer 40, and dye barrier properties for improving the transfer sensitivity, or further required to have solvent resistance in order to stack the dye layer 40, which is normally comprised of a solvent series, onto the underlying layer 30.

In the present invention, the major component of the underlying layer 30 is a copolymer of polyester having a sulfonic group on the side chain, and acrylic having at least one of a glycidyl group and a carboxyl group.

The major component of the underlying layer 30 herein refers to a copolymer, as far as the advantageous effects of the present invention are not impaired, which includes polyester having a sulfonic group on the side chain, and acrylic having at least one of a glycidyl group and a carboxyl group, and which may further additionally include other components. In other words, this means that the underlying layer 30 contains the above copolymer by more than 50 mass % relative to the entirety of the underlying layer 30 when it is formed, but preferably by not less than about 80 mass %.

The polyester component having a sulfonic group is essential to obtaining adhesiveness with the base 10 and the dye layer 40 and solvent resistance.

Further, the acrylic component having at least one of a glycidyl group and a carboxyl group is essential to obtaining dye barrier properties and solvent resistance.

When the individual components are simply blended, good compatibility is not obtained between the acrylic component and the polyester component. This leads to not only loss of the stability as materials, but also loss of the adhesiveness possessed by the polyester component with respect to the base 10 and the dye layer 40, as well as loss of solvent resistance and dye barrier properties possessed by the acrylic component. Thus, the obtained performance is lowered compared to the case where the individual components are used singly.

This is considered to be due to the formation of a non-compatible sea-island structure that is ascribed to the blending of the polymers having bad compatibility, which leads to local presence of the polyester component having adhesiveness and the acrylic component having dye barrier properties (but there are portions having bad adhesiveness and portions having bad barrier properties when the underlying layer 30 is viewed as a whole).

On the other hand, when the acrylic component and the polyester component are copolymerized, the bad compatibility is considered to be improved to prevent the occurrence of phase separation, allowing the acrylic component and the polyester component to be present throughout the underlying layer 30, thereby effectively developing the functions possessed by the individual components (adhesiveness, solvent resistance and dye barrier properties).

A dicarboxylate component used, that is a copolymer component of the polyester having a sulfonic group on the side chain, can include, for example: an ester-forming sulfonic acid alkali metallic salt compound as an essential component; aromatic dicarboxylic acid, such as phthalic acid, terephthalic acid, dimethyl terephthalate, isophthalic acid, dimethyl isophthalate, 2,5-dimethyl terephthalic acid, 2,6-naphthalene dicarboxylic acid, biphenyl dicarboxylic acid, and orthophthalic acid; aliphatic dicarboxylic acid, such as succinic acid, adipic acid, azelaic acid, sebacic acid, and dodecane dicarboxylic acid; and alicyclic dicarboxylic acid, such as cyclohexane dicarboxylic acid.

Preferably, the dicarboxylate component other than the ester-forming sulfonic acid alkali metallic salt compound is aromatic dicarboxylic acid. The aromatic dicarboxylic acid, which has an aromatic nucleus having a good affinity with hydrophobic plastic, has an advantage of improving adhesiveness or being excellent in hydrolysis resistance. In particular, terephthalic acid and isophthalic acid are preferable.

The ester-forming sulfonic acid alkali metallic salt compound used includes: alkali metallic salt (alkali metallic salt of sulfonic acid), such as sulfo terephthalic acid, 5-sulfo isophthalic acid, 4-sulfo isophthalic acid, and 4-sulfo naphthalene acid-2,7-dicarboxylic acid; and ester-forming derivatives of these compounds. Further, a sodium salt of 5-sulfo isophthalic acid and ester-forming derivatives thereof can be more preferably used. It should be noted that, by possessing a sulfonic group, the solvent resistance can be improved.

Further, the diglycol component used, that is a copolymer component of the polyester, can include, for example, diethylene glycol, and an aliphatic series having 2 to 8 carbons or an alicyclic glycol having 6 to 12 carbons.

Specific examples of the aliphatic series having 2 to 8 carbons or the alicyclic glycol having 6 to 12 carbons that can be used include ethylene glycol, 1,3-propanediol, 1,2-propylene glycol, neopentyl glycol, 1,4-butanediol, 1,4-cyclohexanedimethanol, 1,3-cyclohexanedimethanol, 1,2-cyclohexanedimethanol, 1,6-hexanediol, p-xylene glycol, and triethylene glycol. These can be used singly or in combination of two or more.

The polyester having a sulfonic group can be essential to obtaining adhesiveness between the base 10 and the underlying layer 30 and between the underlying layer 30 and the dye layer 40, however, when used singly, no high transfer sensitivity is obtained and thus an acrylic component is required to be copolymerized.

The acrylic component used can include a glycidyl group-containing radical polymerizable unsaturated monomer used singly, or carboxyl group-containing radical polymerizable unsaturated monomer used singly, or other radical polymerizable unsaturated monomers that can be copolymerized with the above monomers.

In the present invention, the glycidyl group-containing radical polymerizable unsaturated monomer or the carboxyl group-containing radical polymerizable unsaturated monomer is required as the acrylic component. This is because the glycidyl group and the carboxyl group have dye barrier properties owing to the bad compatibility with dyes. In other words, this is because transfer sensitivity is improved owing to the possession of the glycidyl group and the carboxyl group. Further, this is because the solvent resistance is improved against ketone series solvents, such as acetone and methyl ethyl ketone, and ester series solvents, such as ethyl acetate and butyl acetate.

The glycidyl group-containing radical polymerizable unsaturated monomer used can include glycidyl ethers, such as acrylate glycidyl, methacrylate glycidyl, and aryl glycidyl ether.

The carboxyl group-containing radical polymerizable unsaturated monomer used can include acrylic acid, methacrylic acid, crotonic acid, itaconic acid, maleic acid, fumaric acid, 2-carboxyethyl(meth)acrylate, 2-carboxypropyl(meth)acrylate, and 5-carboxypentyl(meth)acrylate.

The radical polymerizable unsaturated monomers that can be copolymerized with the glycidyl group- or carboxyl group-containing radical polymerizable unsaturated monomer can include vinyl esters, unsaturated carboxylate esters, unsaturated carboxylate amides, unsaturated nitriles, acrylic compounds, nitrogen-containing vinyl monomers, hydrocarbon vinyl monomers, or vinylsilane compounds.

The vinyl esters used can include vinyl propionate, vinyl stearate, high-grade tertiary vinyl ester, vinyl chloride, and vinyl bromide.

The unsaturated carboxylate esters used can include methyl acrylate, ethyl acrylate, butyl acrylate, 2-ethylhexyl acrylate, methyl methacrylate, ethyl methacrylate, butyl methacrylate, butyl maleate, octyl maleate, butyl fumarate, octyl fumarate, hydroxyethyl methacrylate, hydroxyethyl acrylate, hydroxypropyl methacrylate, hydroxypropyl acrylate, dimethylaminoethyl methacrylate, dimethylaminoethyl acrylate, ethylene glycol dimethacrylate ester, ethylene glycol diacrylate ester, polyethylene glycol dimethacrylate ester, and polyethylene glycol diacrylate ester.

The unsaturated carboxylate amides used can include acrylamide, methacrylamide, methylol acrylamide, and butoxy methylol acrylamide.

The unsaturated nitriles used can include acrylonitril.

The acrylic compounds used can include allyl acetate, allyl methacrylate, allyl acrylate, and diaryl itaconate.

The nitrogen-containing vinyl monomers used can include vinylpyridine, and vinylimidazole.

The hydrocarbon vinyl monomers used can include ethylene, propylene, hexene, octane, styrene, vinyltoluene, and butadiene.

The vinylsilane compounds used can include dimethyl vinyl methoxy silane, dimethyl vinyl ethoxy silane, methyl vinyl dimethoxy silane, methyl vinyl diethoxy silane, γ-methacryloxy propyl tri-methoxy silane, and γ-methacryloxy propyl dimethoxy silane.

Preferably, the copolymerization ratio of polyester and acrylic is in a range of not less than about 20:80 to not more than about 40:60 in terms of weight ratio.

This is because, if the polyester component is less than about 20%, adhesiveness tends to be insufficient, although high print density is obtained, and, if the polyester component exceeds about 40%, print density tends to be lowered, although sufficient adhesiveness is obtained.

Polyester can be obtained using a technique of subjecting dicarboxylic acid and diglycol to esterification or ester exchange reaction, followed by polycondensation reaction, i.e. can be obtained using a known manufacturing technique. The manufacturing method should not be construed as being particularly limited.

Copolymerization of polyester and acrylic can also be achieved using a known manufacturing technique. The manufacturing method should not be construed as being particularly limited. Accordingly, for example, emulsion polymerization can be achieved by means of a method of emulsifying an acrylic monomer using a polyester fluid dispersion or solution, or a method of dropped an acrylic monomer into a polyester fluid dispersion or solution.

The dry coating amount of the underlying layer 30 should not be necessarily limited but is preferably be in a range of not less than about 0.05 g/m$^2$ to not more than about 0.30 g/m$^2$.

This is because, if the dry coating amount of the underlying layer 30 is less than about 0.05 g/m$^2$, the underlying layer 30 is deteriorated in a state where the dye layer 40 is stacked and thus the transfer sensitivity in high-speed printing becomes insufficient, leading to a concern of creating a problem in the adhesiveness with the base 10 or the dye layer 40.

On the other hand, if the dry coating amount of the underlying layer 30 exceeds 0.30 g/m$^2$, the sensitivity of the heat-sensitive transfer recording medium 1 itself remains unchanged and the print density is saturated. Thus, when cost is concerned, the dry coating amount of the underlying layer 30 is preferably not more than about 0.30 g/m$^2$.

Further, as long as the advantageous effects of the present invention are not impaired, a known additive may be used, the additive including colloidal inorganic pigment ultrafine particles, an isocyanate compound, a silane coupling agent, a dispersant, a viscosity improver, or a stabilizer. It should be noted that the colloidal inorganic pigment ultrafine particles that can be used include, for example, as known ones in the conventional art, silica (colloidal silica), alumina or alumina hydrate (e.g., alumina sol, colloidal alumina, cationic aluminum oxide or its hydrate, or pseudoboehmite), aluminum silicate, magnesium silicate, magnesium carbonate, magnesium oxide, or titanium oxide.

(Configuration of Dye Layer 40)

The dye layer 40 is formed on a surface of the underlying layer 30 (upper surface in FIG. 1), the surface being on the other side of the surface facing the base 10. Specifically, the dye layer 40 and the base 10 are opposed to each other being interposed by the underlying layer 30. Thus, the underlying layer 30 and the dye layer 40 are formed being successively stacked on the other surface of the base 10 (upper surface in FIG. 1).

The dye layer 40 can be formed using known materials. For example, the dye layer 40 is formed by blending a heat transferrable dye, a binder, a solution and the like to thereby prepare a coating solution for forming a dye layer, followed by coating and drying.

A proper dry coating amount of the dye layer 40 is about 1.0 g/m$^2$. It should be noted that the dye layer 40 may be configured by a single layer of a single color or, alternatively, may be configured by successively and repeatedly forming a plurality of dye layers that contain dyes of different hues on one surface of a base.

The heat transferable dye is a dye that is melted, diffused, or sublimated and transferred by heat.

A yellow component used for the heat transferrable dye can include, for example, Solvent Yellows 56, 16, 30, 93 and 33, and Disperse Yellows 201, 231 and 33.

A magenta component used for the heat transferrable dye can include, for example, C.I. Disperse Violet 31, C.I. Disperse Red 60, C.I. Disperse Violet 26, C.I. Solvent Red 27, or C.I. Solvent Red 19.

A cyan component used for the heat transferrable dye can include, for example, Disperse Blue 354, C.I solvent Blue 63, C.I. Solvent Blue 36, C.I. Solvent Blue 266, C.I. Disperse Blue 257, or C.I. Disperse Blue 24. Further, in general, the dyes set forth above are combined and toned as a dye of black.

As s resin contained in the dye layer 40, a known resin binder can be used and there should not be any particular limitation. Accordingly, as a resin contained in the dye layer 40, mention is made, for example, of: a cellulosic series resin, such as ethyl cellulose, hydroxylethyl cellulose, ethyl hydroxyl cellulose, hydroxylpropyl cellulose, methyl cellulose, or cellulose acetate; a vinyl series resin, such as polyvinyl alcohol, polyvinyl acetate, polyvinyl butyral, polyvinyl acetal, polyvinylpyrrolidone, or polyacrylamide; a polyester resin; a styrene-acrylonitrile copolymer resin; or a phenoxy resin.

Preferably, the formulation ratio of a dye and a resin in the dye layer 40 is in a range of (die)/(resin)=not less than about 10/100 to not more than about 300/100 in terms of a mass standard.

This is because, if the ratio of (die)/(resin) becomes less than about 10/100, the dye is too little and thus the color development sensitivity becomes insufficient and good heat transfer image is not obtained but, if the ratio of (die)/(resin) exceeds about 300/100, the solubility of the dye for the resin is relatively extremely lowered and thus, in the form of the heat-sensitive transfer recording medium is formed, the preservation stability is worsened to easily allow deposition of the dye.

Further, as far as the performance is not impaired, the dye layer 40 may contain a known additive, such as an isocyanate compound, a silane coupling agent, a dispersant, a viscosity improver, or a stabilizer.

(Matters Common to Heat-Resistant Lubricating Layer 20, Underlying Layer 30 and Dye Layer 40)

The heat-resistant lubricating layer 20, the underlying layer 30 and the dye layer 40 can all be formed by performing coating using a known coating method, followed by drying. As an example of the coating method, mention is made of gravure coating, screen printing, spray coating or reverse roll coating.

Example 1

Referring to FIG. 1, hereinafter are shown some examples of manufacture of the heat-sensitive transfer recording medium 1 described in the first embodiment, and some comparative examples. The present invention should not be construed as being limited to the following examples.

First, the materials used for the heat-sensitive transfer recording media of the respective examples of the present invention and of the respective comparative examples are shown. It should be noted that the term "part" in the following description refers to a mass standard as far as no particular mention is made.

(Preparation of Base Having Heat-Resistant Lubricating Layer)

A surface-untreated polyethylene terephthalate film of 4.5 μm was used as the base 10. A heat-resistant lubricating layer coating solution having the following composition was coated onto one surface of the film by means of gravure coating so that a dry coating amount was 0.5 g/m$^2$, followed by drying at 100° C. for one minute, thereby preparing the base 10 on which the heat-resistant lubricating layer 20 was formed (base having a heat-resistant lubricating layer).

Heat-Resistant Lubricating Layer Coating Solution

| | |
|---|---|
| Silicon acrylate (US-350 of Toagosei Co., Ltd.) | 50.0 parts |
| MEK | 50.0 parts |

(Method of Preparing Sulfonic Group-Containing Polyester/Glycidyl Group-Containing Acryl Copolymer)

A four-necked flask having a distillation tube, a nitrogen inlet tube, a thermometer and an agitator was charged with dimethyl terephthalate by 854 mass, 5-sodium sulfo isophthalic acid by 355 mass, ethylene glycol by 186 mass and diethylene glycol 742 mass, as well as zinc acetate by 1 mass as a reactive catalyzer. The flask with the content was heated over two hours to 130° C. to 170° C. and then antimony trioxide was added by 1 mass, followed by heating over two hours to 170° C. to 200° C. for esterification reaction.

Then, the flask with the content was gradually heated up, decompressed, followed by finally performing polycondensation over 1 to 2 hours at a reaction temperature of 250° C. and a vacuum of not more than 1 mmHg, thereby obtaining sulfonic group-containing polyester. Then, the resultant sulfonic group-containing polyester was dissolved into pure water, followed by adding glycidyl methacrylate, as a glycidyl group-containing acrylic monomer, so that a weight ratio of 30:70 in terms of polyester was achieved, further followed by adding potassium persulfate, as a polymerization initiator, thereby preparing a monomer emulsified liquid.

Then, a reaction container having a cooling tube was charged with pure water and the above monomer emulsified liquid, followed by blowing a nitrogen gas for 20 minutes for sufficient deoxidization. After that, the reaction container with the content was gradually heated over one hour, followed by three-hour reaction retaining 75° C. to 85° C., thereby obtaining a copolymer of sulfonic group-containing polyester and glycidyl group-containing acrylic. Further, the similar method was used for obtaining a copolymer of sulfonic group-containing polyester and carboxyl group-containing acrylic, as well as polyester/acrylic copolymers of respective polymerization ratios.

Example 1-1

The underlying layer 30 was formed by coating an underlying layer coating solution 1-1 of the following composition onto an untreated surface of a base having a heat-resistant lubricating layer by means of gravure coating, so that a dry coating amount was 0.20 g/m$^2$, followed by drying for two minutes at 100° C. Further, the dye layer 40 was formed by coating a dye layer coating solution of the following composition onto the underlying layer 30 formed as above by means of gravure coating, so that a dry coating amount was 0.70 g/m$^2$, followed by drying for one minute at 90° C. Thus, the heat-sensitive transfer recording medium 1 of Example 1-1 was obtained.

Underlying Layer Coating Solution 1-1

| | |
|---|---|
| Sulfonic group-containing polyester/glycidyl group-containing acrylic copolymer (30:70) | 5.00 parts |
| Pure water | 47.5 parts |
| Isopropyl alcohol | 47.5 parts |

Dye Layer Coating Solution

| | |
|---|---|
| C.I. Solvent Blue-63 | 6.0 parts |
| Polyvinyl acetal resin | 4.0 parts |
| Toluene | 45.0 parts |
| Methyl ethyl ketone | 45.0 parts |

Example 1-2

The heat-sensitive transfer recording medium 1 of Example 1-2 was obtained in a manner similar to that of Example 1-1, except that the underlying layer 30 was formed using an underlying layer coating solution 1-2 of the following composition, in the heat-sensitive transfer recording medium 1 prepared in Example 1-1.

Underlying Layer Coating Solution 1-2

| | |
|---|---|
| Sulfonic group-containing polyester/carboxyl group-containing acrylic copolymer (30:70) | 5.00 parts |
| Pure water | 47.5 parts |
| Isopropyl alcohol | 47.5 parts |

Example 1-3

The heat-sensitive transfer recording medium 1 of Example 1-3 was obtained in a manner similar to that of Example 1-1, except that the underlying layer 30 was formed using an underlying layer coating solution 1-3 of the following composition, in the heat-sensitive transfer recording medium 1 prepared in Example 1-1.

Underlying Layer Coating Solution 1-3

| | |
|---|---|
| Sulfonic group-containing polyester/glycidyl group-containing acrylic copolymer (20:80) | 5.00 parts |
| Pure water | 47.5 parts |
| Isopropyl alcohol | 47.5 parts |

Example 1-4

The heat-sensitive transfer recording medium 1 of Example 1-4 was obtained in a manner similar to that of Example 1-1, except that the underlying layer 30 was formed using an underlying layer coating solution 1-4 of the following composition, in the heat-sensitive transfer recording medium 1 prepared in Example 1-1.

Underlying Layer Coating Solution 1-4

| | |
|---|---|
| Sulfonic group-containing polyester/glycidyl group-containing acrylic copolymer (40:60) | 5.00 parts |
| Pure water | 47.5 parts |
| Isopropyl alcohol | 47.5 parts |

Example 1-4

The heat-sensitive transfer recording medium 1 of Example 1-5 was obtained in a manner similar to that of Example 1-1, except that the underlying layer 30 was coated with a dry coating amount of 0.03 g/m$^2$, followed by drying, in the heat-sensitive transfer recording medium 1 prepared in Example 1-1.

Example 1-6

The heat-sensitive transfer recording medium 1 of Example 1-6 was obtained in a manner similar to that of Example 1-1, except that the underlying layer 30 was coated with a dry coating amount of 0.35 g/m$^2$, followed by drying, in the heat-sensitive transfer recording medium 1 prepared in Example 1-1.

Comparative Example 1-1

Without forming the underlying layer 30, the dye layer 40 was formed by coating a dye layer coating solution similar to that of Example 1-1 onto an untreated surface of a base having a heat-resistant lubricating layer by means of gravure coating, so that a dry coating amount was 0.70 g/m$^2$, followed by drying for one minute at 90° C., thereby obtaining the heat-sensitive transfer recording medium 1 of Comparative Example 1-1.

Comparative Example 1-2

The heat-sensitive transfer recording medium 1 of Comparative Example 1-2 was obtained in a manner similar to that of Example 1-1, except that the underlying layer 30 was formed using an underlying layer coating solution 1-5 having the following composition, in the heat-sensitive transfer recording medium 1 prepared in Example 1-1.

Underlying Layer Coating Solution 1-5

| | |
|---|---|
| Sulfonic group-containing polyester resin | 5.00 parts |
| Pure water | 47.5 parts |
| Isopropyl alcohol | 47.5 parts |

Comparative Example 1-3

The heat-sensitive transfer recording medium 1 of Comparative Example 1-3 was obtained in a manner similar to that of Example 1-1, except that the underlying layer 30 was formed using an underlying layer coating solution 1-6 having the following composition, in the heat-sensitive transfer recording medium 1 prepared in Example 1-1.

Underlying Layer Coating Solution 1-6

| | |
|---|---|
| Glycidyl group-containing acrylic resin | 5.00 parts |
| Pure water | 47.5 parts |
| Isopropyl alcohol | 47.5 parts |

Comparative Example 1-4

The heat-sensitive transfer recording medium 1 of Comparative Example 1-4 was obtained in a manner similar to that of Example 1-1, except that the underlying layer 30 was formed using an underlying layer coating solution 1-7 of the following composition, in the heat-sensitive transfer recording medium 1 prepared in Example 1-1.

Underlying Layer Coating Solution 1-7

| | |
|---|---|
| Carboxyl group-containing acrylic resin | 5.00 parts |
| Pure water | 47.5 parts |
| Isopropyl alcohol | 47.5 parts |

Comparative Example 1-5

The heat-sensitive transfer recording medium 1 of Comparative Example 1-5 was obtained in a manner similar to that of Example 1-1, except that the underlying layer 30 was formed using an underlying layer coating solution 1-8 having the following composition, in the heat-sensitive transfer recording medium 1 prepared in Example 1-1.

Underlying Layer Coating Solution 1-8

| | |
|---|---|
| Glycidyl group-containing acrylic resin | 7.00 parts |
| Sulfonic group-containing polyester resin | 3.00 parts |
| Pure water | 45.0 parts |
| Isopropyl alcohol | 45.0 parts |

Comparative Example 1-6

The heat-sensitive transfer recording medium 1 of Comparative Example 1-6 was obtained in a manner similar to that of Example 1-1, except that the underlying layer 30 was formed using an underlying layer coating solution 1-9 having the following composition, in the heat-sensitive transfer recording medium 1 prepared in Example 1-1.

Underlying Layer Coating Solution 1-9

| | |
|---|---|
| Alumina sol | 5.00 parts |
| Polyvinyl alcohol | 5.00 parts |
| Pure water | 45.0 parts |
| Isopropyl alcohol | 45.0 parts |

(Preparation of Object to be Transferred)

A white-foam polyethylene terephthalate film of 188 μm was used as the base 10 to prepare an object to be transferred for heat-sensitive transfer by coating an image-receiving layer coating solution having the following composition onto one surface of the film by means of gravure coating so that a dry coating amount was 5.0 g/m$^2$, followed by drying.

Image-Receiving Layer Coating Solution

| | |
|---|---|
| Vinyl chloride/vinyl acetate/vinyl alcohol copolymer | 19.5 parts |
| Amino-modified silicone oil | 0.5 parts |
| Toluene | 40.0 parts |
| Methyl ethyl ketone | 40.0 parts |

(Evaluation on Printing)

Printing was performed by means of a thermal simulator on the heat-sensitive transfer recording media 1 of Examples 1-1 to 1-6 and Comparative Examples 1-1 to 1-6 to evaluate maximum reflection density. The results are shown in Table 1. It should be noted that the maximum reflection density corresponds to a value obtained through measurement of a printed portion in which no abnormal transfer is observed by means of X-Rite 528.

Printing conditions herein are as follows.

Printing Conditions

Printing environment: 23° C. 50% RH

Applied voltage: 29 V

Line period: 0.7 msec

Print density: Horizontal scan 300 dpi, Vertical scan 300 dpi (Evaluation on Abnormal Transfer)

Evaluation on abnormal transfer was conducted along the line set forth below. It should be noted that a level of Δ○ or more involves no practical problem.

○: No abnormal transfer to an object to be transferred is observed.

Δ○: Abnormal transfer to an object to be transferred is quite slightly observed.

Δ: Abnormal transfer to an object to be transferred is slightly observed.

X: Abnormal transfer to an object to be transferred is observed throughout the whole surface.

TABLE 1

| | Dry coating amount of underlying layer [g/m$^2$] | Polyester-acryl copolymerization ratio (weight ratio) Sulfonic group-containing polyester | Glycidyl group-containing acryl | Carboxyl group-containing acryl | Maximum reflection density 255/255 | Abnormal transfer |
|---|---|---|---|---|---|---|
| Example 1-1 | 0.20 | 30 | 70 | — | 2.45 | ○ |
| Example 1-2 | 0.20 | 30 | — | 70 | 2.43 | ○ |
| Example 1-3 | 0.20 | 20 | 80 | — | 2.49 | Δ○ |
| Example 1-4 | 0.20 | 40 | 60 | — | 2.43 | ○ |
| Example 1-5 | 0.03 | 30 | 70 | — | 2.40 | Δ○ |
| Example 1-6 | 0.35 | 30 | 70 | — | 2.46 | ○ |
| Comparative Example 1-1 | — | — | — | — | 1.85 | X |
| Comparative Example 1-2 | 0.20 | 100 | — | — | 2.00 | ○ |
| Comparative Example 1-3 | 0.20 | — | 100 | — | 2.50 | X |
| Comparative Example 1-4 | 0.20 | — | — | 100 | 2.47 | X |
| Comparative Example 1-5 | 0.20 | Blend of polyester/glycidyl group-containing acryl (30/70) | | | 2.25 | X |
| Comparative Example 1-6 | 0.20 | Alumina sol/polyvinyl alcohol | | | 2.40 | Δ |

From the results of Table 1, it has been demonstrated that the copolymer of sulfonic group-containing polyester and glycidyl group- or carboxyl group-containing acrylic has high transfer sensitivity in high-speed printing, compared to Comparative Example 1-1 that was provided with no underlying layer 30 and Comparative Example 1-2 that used sulfonic group-containing polyester alone. Although the base 10 having untreated surface was used in the Examples, no abnormal transfer was observed.

Although the transfer sensitivity was demonstrated to be high in high-speed printing in Comparative Examples 1-3 and 1-4 that used the copolymer containing carboxyl group- or glycidyl group-containing acrylic and in Comparative Example 1-6 that used alumina sol/polyvinyl alcohol, abnormal transfer was observed. Further, in Comparative Example 1-2 that used sulfonic group-containing polyester alone, occurrence of abnormal transfer was not observed, although the transfer sensitivity in high-speed printing was low. In Comparative Example 5 in which sulfonic group-containing polyester was blended with glycidyl group-containing acrylic at 30:70 (weight ratio), transfer sensitivity was low and abnormal transfer was observed.

Thus, from the comparison with Example 1-1, it became apparent that copolymerization of sulfonic group-containing polyester and glycidyl group-containing acrylic was preferable.

Further, Example 1-5, in which coating amount of the underlying layer 30 was less than 0.05 g/m$^2$, showed lowering in transfer sensitivity and adhesiveness to some extent, comparing to the heat-sensitive transfer recording medium 1 of Example 1-1.

Furthermore, comparison of the heat-sensitive transfer recording medium 1 of Example 1-6 with the heat-sensitive transfer recording medium 1 of Example 1-1 demonstrated that, although dry coating amount of the underlying layer 30 of the former exceeded 30 g/m$^2$, transfer sensitivity and adhesiveness were substantially the same between the both.

As described above, the heat-sensitive transfer recording medium 1 related to the present embodiment uses, as a major component of the underlying layer 30, a copolymer of polyester having a sulfonic group on a side chain and acrylic having at least one of glycidyl and carboxyl groups. The heat-sensitive transfer recording medium 1 obtained in this way can suppress the occurrence of abnormal transfer when high-speed printing is conducted by increasing the energy applied to the thermal head of a high-speed printer of sublimation transfer type, and can improve the transfer sensitivity in the high-speed printing.

Second Embodiment

In the technical field related to the present invention, there is another problem, other than the ones mentioned above, that use of a high-speed printer with the application of much energy in a short time causes the dye layer to be stuck to an object to be transferred during the high-speed printing, due to the insufficient releasability between the dye layer and the object to be transferred, thereby causing uneven transfer in the printed matter. Further, still another problem is that, in abnormal transfer, a resin is entirely transferred to an object to be heat-transferred. Various release agents have been investigated to solve the problem of sticking. However, there is a concern that another problem of depositing dye with time is created, depending on the types of the release agents.

A heat transfer sheet that has been proposed as a measure against dye deposition, for example, includes an ink layer that contains a surfactant having an HLB value of not less than 10 (see JP-A-2005-313359). This heat transfer sheet is able to prevent scumming due to dye deposition that is ascribed to aged deterioration, and is able to obtain an image of excellent density and sensitivity. It should be noted that the HLB value (hydrophile-lipophile balance) refers to a value that expresses a degree of affinity of a surfactant to water and oil (organic compound insoluble in water).

However, when printing was conducted in the same way using the heat-sensitive transfer recording medium proposed in JP-A-2005-313359, the print density was confirmed not to be sufficient. Further, it was confirmed that, when the heat-sensitive transfer recording medium containing a surfactant with an HLB value of not less than 10 was stored in an environment of high temperature and high humidity, hydrophilic groups of the surfactant were increased in the surface of the dye layer, allowing the dye to be deposited being adversely affected by the moisture in the air.

In this way, a heat-sensitive transfer recording medium is yet to be developed, which satisfies all the quality requirements of ensuring high print density, eliminating sticking during heat transfer, and ensuring storage stability in a high-temperature and high-humidity environment.

A second embodiment of the present invention can help to ameliorate or solve the above problem.

Hereinafter is described the second embodiment of the heat-sensitive transfer recording medium related to the present invention.

(General Configuration)

The heat-sensitive transfer recording medium related to the present embodiment has a structure similar to that of the heat-sensitive transfer recording medium 1 described in the first embodiment. In other words, as shown in FIG. 1, the heat-sensitive transfer recording medium related to the present embodiment includes a base 10 having a surface on which a heat-resistant lubricating layer 20 is formed and the other surface on which an underlying layer 30 and a dye layer 40 are successively stacked and formed.

It should be noted that, compared to the first embodiment, the present embodiment is chiefly different in the quality of the material of the dye layer 40 but the rest remains unchanged. Accordingly, the description herein is focused on only the quality of the material of the dye layer 40 and description on the rest is omitted.

(Dye Layer 40)

The dye layer 40 of the present embodiment contains at least a dye, a resin and a release agent. The dye and the resin contained in the dye layer 40 are the same as those contained in the dye layer 40 described in the first embodiment. Accordingly, description on these is omitted in the present embodiment. Hereinafter, the release agent used in the present embodiment is described.

Preferably, the release agent of the present embodiment is a non-reactive polyether-modified silicone having a viscosity of not less than about 800 mm$^2$/s at 25° C. and an HLB value of not more than about 10. This is because the viscosity of not less than about 800 mm$^2$/s can exhibit good releasability during heat transfer. Further, the reason why an HLB value of not more than about 10 is preferred is that no deposition of dye is caused with this value after storage of several days in a high-temperature and high-humidity environment, such as 40° C.90% RH, thereby preventing scumming.

The release agent related to the present embodiment preferably has a viscosity of not less than about 900 mm$^2$/s, more preferably not less than about 1000 mm$^2$/s, at 25° C. A higher viscosity ensures more increase of releasability, contributing to exerting good releasability, for example, in the case where printing is conducted under a high-temperature and high-humidity environment, and in the case where the releasability of an object to be transferred is insufficient, or in the case where printing is conducted at a higher speed.

More preferably, the release agent of the present embodiment has an HLB value of not more than about 8. The HLB value of not more than about 8 can prevent scumming without causing dye deposition after a long storage in a high-temperature and high-humidity environment.

Preferably, an addition amount of the release agent of the present embodiment ranges from not less than about 0.5 wt % to not more than about 10 wt % relative to the resin, and more preferably ranges from not less than about 1.0 wt % to not more than about 5 wt %. If the addition amount is less than 0.5 wt %, no sufficient release performance can be exhibited during heat transfer. Further, an addition amount larger than 10 wt % causes scumming when the recording medium is stored in a high-temperature and high-humidity environment, or causes printing wrinkles during heat transfer due to the lowering of heat resistance of the dye layer.

It should be appreciated that, as long as adhesiveness, dye barrier properties and solvent resistance are ensured, the underlying layer 30 related to the present embodiment may be based on the conventional art. For example, as the underlying layer, mention can be made of polyvinyl alcohol and a modification/copolymer thereof, polyvinyl pyrrolidone and a modification/copolymer thereof, a copolymer of polyester and acrylic, starch, gelatin, methylcellulose, ethylcellulose, carboxylmethylcellulose, or the like.

Example 2

Referring to FIG. 1, hereinafter are described some examples of manufacture of the heat-sensitive transfer recording medium 1 described in the second embodiment, and some comparative examples. The present invention should not be construed as being limited to the following examples.

First, the materials used for the heat-sensitive transfer recording media of the respective examples of the present invention and the respective comparative examples are shown. It should be noted that the term "part" in the following description refers to a mass standard as far as no particular mention is made.

(Preparation of Base Having Heat-Resistant Lubricating Layer)

A surface-untreated polyethylene terephthalate film of 4.5 μm was used as the base 10. A heat-resistant lubricating layer coating solution having the following composition was coated onto one surface of the film by means of gravure coating so that a dry coating amount was 0.5 g/m$^2$, followed by drying at 100° C. for one minute, thereby preparing the base 10 on which the heat-resistant lubricating layer 20 was formed (base having a heat-resistant lubricating layer).

Heat-Resistant Lubricating Layer Coating Solution

| | |
|---|---|
| Silicon acrylate (US-350 of Toagosei Co., Ltd.) | 50.0 parts |
| MEK | 50.0 parts |

(Method of Preparing Sulfonic Group-Containing Polyester/Glycidyl Group-Containing Acrylic Copolymer)

A four-necked flask having a distillation tube, a nitrogen inlet tube, a thermometer and an agitator was charged with dimethyl terephthalate by 854 parts, 5-sodium sulfo isophthalic acid by 355 parts, ethylene glycol by 186 parts and diethylene glycol by 742 parts, as well as zinc acetate by 1 part as a reactive catalyzer. The flask with the content was heated over two hours to 130° C. to 170° C. and then antimony trioxide was added by 1 parts, followed by heating over two hours to 170° C. to 200° C. for esterification reaction.

Then, the flask with the content was gradually heated up, decompressed, followed by finally performing polycondensation over 1 to 2 hours at a reaction temperature of 250° C. and a vacuum of not more than 1 mmHg, thereby obtaining sulfonic group-containing polyester. Then, the resultant sulfonic group-containing polyester was dissolved into pure water, followed by adding glycidyl methacrylate, as a glycidyl group-containing acrylic monomer, so that a weight ratio of 30:70 in terms of polyester is achieved, further followed by adding potassium persulfate, as a polymerization initiator, thereby preparing a monomer emulsified liquid.

Then, a reaction container having a cooling tube was charged with pure water and the above monomer emulsified liquid, followed by blowing a nitrogen gas for 20 minutes for sufficient deoxidization. After that, the reaction container with the content was gradually heated over one hour, followed by three-hour reaction retaining 75° C. to 85° C., thereby obtaining a copolymer of sulfonic group-containing polyester and glycidyl group-containing acrylic. Further, the similar method was used for obtaining a copolymer of sulfonic group-containing polyester and carboxyl group-containing acrylic, as well as polyester/acrylic copolymers of respective polymerization ratios.

Example 2-1

The underlying layer 30 was formed by coating an underlying layer coating solution 2-1 having the following composition onto an untreated surface of a base having a heat-resistant lubricating layer by means of gravure coating, so that a dry coating amount was 0.20 g/m$^2$, followed by drying for two minutes at 100° C. Further, the dye layer 40 was formed by coating a dye layer coating solution 2-1 having the following composition onto the underlying layer 30 formed as above by means of gravure coating, so that a dry coating amount was 0.70 g/m$^2$, followed by drying for one minute at 90° C. Thus, the heat-sensitive transfer recording medium 1 of Example 2-1 was obtained.

Underlying Layer Coating Solution 2-1

| | |
|---|---|
| Sulfonic group-containing polyester/glycidyl group-containing acryl copolymer (30:70) | 5.00 parts |
| Pure water | 47.5 parts |
| Isopropyl alcohol | 47.5 parts |

Dye Layer Coating Solution 2-1

| | |
|---|---|
| C.I. Solvent Blue-63 | 6.0 parts |
| Polyvinyl acetal resin | 4.0 parts |
| Non-reactive polyether-modified silicone (Viscosity: 800 mm$^2$/s, HLB: 10) | 0.2 parts |
| Toluene | 45.0 parts |
| Methyl ethyl ketone | 45.0 parts |

Example 2-2

The heat-sensitive transfer recording medium 1 of Example 2-2 was obtained in a manner similar to that of Example 2-1, except that the dye layer 40 was formed using a dye layer coating solution 2-2 having the following composition, in the heat-sensitive transfer recording medium 1 prepared in Example 2-1.

Dye Layer Coating Solution 2-2

| | |
|---|---|
| C.I. Solvent Blue-63 | 6.0 parts |
| Polyvinyl acetal resin | 4.0 parts |
| Non-reactive polyether-modified silicone (Viscosity: 800 mm$^2$/s, HLB: 10) | 0.02 parts |
| Toluene | 45.0 parts |
| Methyl ethyl ketone | 45.0 parts |

Example 2-3

The heat-sensitive transfer recording medium 1 of Example 2-3 was obtained in a manner similar to that of Example 2-1, except that the dye layer 40 was formed using a dye layer coating solution 2-3 having the following composition, in the heat-sensitive transfer recording medium 1 prepared in Example 2-1.

Dye Layer Coating Solution 2-3

| | |
|---|---|
| C.I. Solvent Blue-63 | 6.0 parts |
| Polyvinyl acetal resin | 4.0 parts |
| Non-reactive polyether-modified silicone (Viscosity: 800 $mm^2/s$, HLB: 10) | 0.4 parts |
| Toluene | 45.0 parts |
| Methyl ethyl ketone | 45.0 parts |

Example 2-4

The heat-sensitive transfer recording medium 1 of Example 2-4 was obtained in a manner similar to that of Example 2-1, except that the dye layer 40 was formed using a dye layer coating solution 2-4 having the following composition, in the heat-sensitive transfer recording medium 1 prepared in Example 2-1.

Dye Layer Coating Solution 2-4

| | |
|---|---|
| C.I. Solvent Blue-63 | 6.0 parts |
| Polyvinyl acetal resin | 4.0 parts |
| Non-reactive polyether-modified silicone (Viscosity: 800 $mm^2/s$, HLB: 8) | 0.2 parts |
| Toluene | 45.0 parts |
| Methyl ethyl ketone | 45.0 parts |

Example 2-5

The heat-sensitive transfer recording medium 1 of Example 2-5 was obtained in a manner similar to that of Example 2-1, except that the dye layer 40 was formed using a dye layer coating solution 2-5 of the following composition, in the heat-sensitive transfer recording medium 1 prepared in Example 2-1.

Dye Layer Coating Solution 2-5

| | |
|---|---|
| C.I. Solvent Blue-63 | 6.0 parts |
| Polyvinyl acetal resin | 4.0 parts |
| Non-reactive polyether-modified silicone (Viscosity: 1200 $mm^2/s$, HLB: 10) | 0.2 parts |
| Toluene | 45.0 parts |
| Methyl ethyl ketone | 45.0 parts |

Example 2-6

The heat-sensitive transfer recording medium 1 of Example 2-6 was obtained in a manner similar to that of Example 2-1, except that the underlying layer 30 was formed using an underlying layer coating solution 2-2 having the following composition, in the heat-sensitive transfer recording medium 1 prepared in Example 2-1.

Underlying Layer Coating Solution 2-2

| | |
|---|---|
| Sulfonic group-containing polyester/carboxyl group-containing acrylic copolymer (30:70) | 5.00 parts |
| Pure water | 47.5 parts |
| Isopropyl alcohol | 47.5 parts |

Example 2-7

The heat-sensitive transfer recording medium 1 of Example 2-7 was obtained in a manner similar to that of Example 2-1, except that the underlying layer 30 was formed using an underlying layer coating solution 2-3 having the following composition, in the heat-sensitive transfer recording medium 1 prepared in Example 2-1.

Underlying Layer Coating Solution 2-3

| | |
|---|---|
| Polyvinyl alcohol/polyvinyl pyrrolidone blend (50:50) | 5.00 parts |
| Pure water | 47.5 parts |
| Isopropyl alcohol | 47.5 parts |

Example 2-8

The heat-sensitive transfer recording medium 1 of Example 2-8 was obtained in a manner similar to that of Example 2-1, except that the underlying layer 30 was coated so that a dry coating amount was 0.03 $g/m^2$, followed by drying, in the heat-sensitive transfer recording medium 1 prepared in Example 2-1.

Example 2-9

The heat-sensitive transfer recording medium 1 of Example 2-9 was obtained in a manner similar to that of Example 2-1, except that the underlying layer 30 was coated so that a dry coating amount was 0.35 $g/m^2$, followed by drying, in the heat-sensitive transfer recording medium 1 prepared in Example 2-1.

Example 2-10

The heat-sensitive transfer recording medium 1 of Example 2-10 was obtained in a manner similar to that of Example 2-1, except that the underlying layer 30 was formed using an underlying layer coating solution 2-4 having the following composition, in the heat-sensitive transfer recording medium 1 prepared in Example 2-1.

Underlying Layer Coating Solution 2-4

| | |
|---|---|
| Sulfonic group-containing polyester/glycidyl group-containing acrylic copolymer (10:90) | 5.00 parts |
| Pure water | 47.5 parts |
| Isopropyl alcohol | 47.5 parts |

Example 2-11

The heat-sensitive transfer recording medium 1 of Example 2-11 was obtained in a manner similar to that of Example 2-1, except that the underlying layer 30 was formed using an underlying layer coating solution 2-5 having the following composition, in the heat-sensitive transfer recording medium 1 prepared in Example 2-1.

Underlying Layer Coating Solution 2-5

| | |
|---|---|
| Sulfonic group-containing polyester/glycidyl group-containing acrylic copolymer (50:50) | 5.00 parts |
| Pure water | 47.5 parts |
| Isopropyl alcohol | 47.5 parts |

Comparative Example 2-1

Without forming the underlying layer 30, the dye layer 40 was formed by coating a dye layer coating solution similar to that of Example 2-1 onto an untreated surface of a base having a heat-resistant lubricating layer by means of gravure coating, so that a dry coating amount was 0.70 g/m$^2$, followed by drying for one minute at 90° C., thereby obtaining the heat-sensitive transfer recording medium 1 of Comparative Example 2-1.

Comparative Example 2-2

The heat-sensitive transfer recording medium 1 of Comparative Example 2-2 was obtained in a manner similar to that of Example 2-1, except that the dye layer 40 was formed using a dye layer coating solution 2-6 having the following composition, in the heat-sensitive transfer recording medium 1 prepared in Example 2-1.

Dye Layer Coating Solution 2-6

| | |
|---|---|
| C.I. Solvent Blue-63 | 6.0 parts |
| Polyvinyl acetal resin | 4.0 parts |
| Non-reactive polyether-modified silicone (Viscosity: 400 mm$^2$/s, HLB: 10) | 0.2 parts |
| Toluene | 45.0 parts |
| Methyl ethyl ketone | 45.0 parts |

Comparative Example 2-3

The heat-sensitive transfer recording medium 1 of Comparative Example 2-3 was obtained in a manner similar to that of Example 2-1, except that the dye layer 40 was formed using a dye layer coating solution 2-7 having the following composition, in the heat-sensitive transfer recording medium 1 prepared in Example 2-1.

Dye Layer Coating Solution 2-7

| | |
|---|---|
| C.I. Solvent Blue-63 | 6.0 parts |
| Polyvinyl acetal resin | 4.0 parts |
| Non-reactive polyether-modified silicone (Viscosity: 800 mm$^2$/s, HLB: 14) | 0.2 parts |
| Toluene | 45.0 parts |
| Methyl ethyl ketone | 45.0 parts |

Comparative Example 2-4

The heat-sensitive transfer recording medium 1 of Comparative Example 2-4 was obtained in a manner similar to that of Example 2-1, except that the dye layer 40 was formed using a dye layer coating solution 2-8 having the following composition, in the heat-sensitive transfer recording medium 1 prepared in Example 2-1.

Dye Layer Coating Solution 2-8

| | |
|---|---|
| C.I. Solvent Blue-63 | 6.0 parts |
| Polyvinyl acetal resin | 4.0 parts |
| Non-reactive polyether-modified silicone (Viscosity: 800 mm$^2$/s, HLB: 10) | 0.01 parts |
| Toluene | 45.0 parts |
| Methyl ethyl ketone | 45.0 parts |

Comparative Example 2-5

The heat-sensitive transfer recording medium 1 of Comparative Example 2-5 was obtained in a manner similar to that of Example 2-1, except that the dye layer 40 was formed using a dye layer coating solution 2-9 having the following composition, in the heat-sensitive transfer recording medium 1 prepared in Example 2-1.

Dye Layer Coating Solution 2-9

| | |
|---|---|
| C.I. Solvent Blue-63 | 6.0 parts |
| Polyvinyl acetal resin | 4.0 parts |
| Non-reactive polyether-modified silicone (Viscosity: 800 mm$^2$/s, HLB: 10) | 0.6 parts |
| Toluene | 45.0 parts |
| Methyl ethyl ketone | 45.0 parts |

Comparative Example 2-6

The heat-sensitive transfer recording medium 1 of Comparative Example 2-6 was obtained in a manner similar to that of Example 2-1, except that the dye layer 40 was formed using a dye layer coating solution 2-10 having the following composition, in the heat-sensitive transfer recording medium 1 prepared in Example 2-1.

Dye Layer Coating Solution 2-10

| | |
|---|---|
| C.I. Solvent Blue-63 | 6.0 parts |
| Polyvinyl acetal resin | 4.0 parts |
| Non-reactive phenyl-modified silicone (Viscosity: 1000 mm$^2$/s) | 0.2 parts |
| Toluene | 45.0 parts |
| Methyl ethyl ketone | 45.0 parts |

(Preparation of Object to be Transferred)

A white-foam polyethylene terephthalate film of 188 μm was used as the base 10 to prepare an object to be transferred for heat-sensitive transfer by coating an image-receiving layer coating solution having the following composition onto one surface of the film by means of gravure coating so that a dry coating amount was 5.0 g/m$^2$, followed by drying.

Image-Receiving Layer Coating Solution

| | |
|---|---|
| Vinyl chloride/vinyl acetate/vinyl alcohol copolymer 19.5 parts Amino-modified silicone oil | 0.5 parts |
| Toluene | 40.0 parts |
| Methyl ethyl ketone | 40.0 parts |

(Evaluation on Printing)

Printing was performed by means of an evaluation thermal printer on the heat-sensitive transfer recording media 1 of Examples 2-1 to 2-11 and Comparative Examples 2-1 to 2-6 to evaluate print density, releasability during heat transfer, and stability (scumming/dye deposition) of the heat-sensitive transfer recording medium when stored in a high-temperature and high-humidity environment. The result are shown in Table 2.

<Print Density>

A black solid image was printed in an environment of 25° C.50% RH, and optical density measurement based on a density measurement Status A was conducted of the resultant printed matters by means of X-rite 528 densitometer (manufactured by X-Rite, Inc.)

<Releasability in Heat Transfer>

A black solid image was printed in environments of 25° C.50% RH and 40° C.90% RH, and evaluation was conducted of releasability in heat transfer, on the basis of the following evaluation criteria.

Evaluation Criteria

⊕: A level of being excellent in releasability without emitting a peeling sound

○: A level of raising no practical problem, but for emission of a little peeling sound in heat transfer X: A level of causing uneven peeling in an image with an emission of sound in heat transfer, or a level of causing abnormal transfer <Stability (Scumming/Dye Deposition) when Stored in a High-Temperature and High-Humidity Environment>

The heat-sensitive transfer recording media 1 were each stored in an environment of 40° C.90% RH for three months, and then a white solid image was printed by means of an evaluation thermal printer. The resultant printed matters were evaluated on the basis of the following criteria.

Evaluation Criteria

○: Scumming not caused (no dye deposition caused)

X: Scumming caused (dye deposition caused)

TABLE 2

| | Print density | Releasability in heat transfer | | 40° C. 90% Storage period |
|---|---|---|---|---|
| | Black solid | 25° C. 50% | 40° C. 90% | Three months |
| Example 2-1 | 2.45 | ⊕ | ⊕ | ○ |
| Example 2-2 | 2.45 | ⊕ | ⊕ | ○ |
| Example 2-3 | 2.45 | ⊕ | ⊕ | ○ |
| Example 2-4 | 2.45 | ⊕ | ⊕ | ○ |
| Example 2-5 | 2.45 | ⊕ | ⊕ | ○ |
| Example 2-6 | 2.43 | ⊕ | ⊕ | ○ |
| Example 2-7 | 2.49 | ⊕ | ○ | ○ |
| Example 2-8 | 2.40 | ⊕ | ○ | ○ |
| Example 2-9 | 2.46 | ⊕ | ⊕ | ○ |
| Example 2-10 | 2.50 | ⊕ | ○ | ○ |
| Example 2-11 | 2.35 | ⊕ | ⊕ | ○ |
| Comparative Example 2-1 | 1.85 | X | X | ○ |
| Comparative Example 2-2 | 2.45 | X | X | ○ |
| Comparative Example 2-3 | 2.45 | ⊕ | ⊕ | X |
| Comparative Example 2-4 | 2.45 | X | X | ○ |
| Comparative Example 2-5 | 2.40 | ⊕ | ⊕ | X |
| Comparative Example 2-6 | 2.45 | X | X | X |

From the results shown in Table 2, the advantageous effects of the present embodiment, that is, high print density, excellent releasability in heat transfer, and no occurrence of problem, such as dye deposition after long-time storage under high-temperature and high-humidity environment, were confirmed in Examples 2-1 to 2-11, in each of which the underlying layer 30 was provided, and the non-reactive polyether-modified silicone contained in the dye layer 40 had a viscosity of not less than 800 $mm^2/s$ at 25° C. and an HLB value of not more than 10, with an addition amount ranging from not less than 0.5 wt % to not more than 10 wt % relative to the resin.

In particular, Examples 2-1 to 2-6, in which the underlying layer 30 satisfied specific requirements, were each confirmed to exert especially excellent releasability in the print of 40° C.90% environment as well.

Further, Example 2-7, in which the underlying layer 30 contained a blend of polyvinyl alcohol and polyvinyl pyrrolidone (weight ratio of 50:50), was confirmed to be at a level of raising no practical problem, although a little peeling sound was recognized in the print of 40° C.90% environment, the peeling sound not being reflected in the printed matter.

Example 2-8, in which a dry coating amount of the underlying layer 30 was 0.03 $g/m^2$, showed a little lowering in the print density but was at a level of raising no practical problem. Further, the print of 40° C.90% environment was confirmed to be at a level of raising no practical problem, although a little peeling sound was recognized, which was not reflected in the printed matter.

On the other hand, Example 2-9, in which a dry coating amount of the underlying layer 30 was 0.35 $g/m^2$, showed no problem in the print density, releasability and long-time storage in high-temperature and high-humidity environment.

In Example 2-10, which contained a blend of sulfonic group-containing polyester and glycidyl group-containing acrylic at 10:90 (weight ratio), print density was confirmed to increase to some extent and emission of a little peeling sound was confirmed in the print of 40° C.90% environment. However, it was confirmed that the peeling sound was not reflected in the printed matter, exhibiting a level of raising no practical problem.

In Example 2-11, which contained a blend of sulfonic group-containing polyester and glycidyl group-containing acrylic at 50:50 (weight ratio), print density was confirmed to be lowered but to be at a level of raising no practical problem.

In Comparative Example 2-1 provided with no underlying layer 30, it was confirmed that print density was drastically lowered, and due to the insufficient adhesion between the base and the dye layer, abnormal transfer was observed.

In Comparative Example 2-2, in which the non-reactive polyether-modified silicone contained in the dye layer 40 had a viscosity of 400 $mm^2/s$ at 25° C., releasability in heat transfer was confirmed to be insufficient, allowing the dye layer to be stuck to the object to be transferred.

In Comparative Example 2-3, in which the non-reactive polyether-modified silicone contained in the dye layer 40 had an HLB value of 14, it was confirmed that dye deposition and scumming were caused when the heat-sensitive transfer recording medium 1 was stored in the 40° C.90% environment for three months.

In Comparative Example 2-4, in which the addition amount, relative to the resin, of the non-reactive polyether-modified silicone contained in the dye layer 40 was 0.25%, releasability in heat transfer was confirmed to be insufficient, allowing the dye layer 40 to be stuck to the object to be transferred.

In Comparative Example 2-5, in which the addition amount, relative to the resin, of the non-reactive polyether-modified silicone contained in the dye layer 40 was 15%, it was confirmed that dye deposition and scumming were caused when the heat-sensitive transfer recording medium 1 was stored in the 40° C.90% environment for three months.

In Comparative Example 2-6, in which the release agent contained in the dye layer 40 was the non-reactive phenyl-modified silicone, it was confirmed that releasability was insufficient in heat transfer, the dye layer 40 was stuck to the object to be transferred, and dye deposition and scumming were caused when the heat-sensitive transfer recording medium 1 was stored in the 40° C.90% environment for three months.

As described above, the heat-sensitive transfer recording medium 1 related to the present embodiment can ensure high print density, prevent the dye layer 40 from being stuck to the object to be transferred during heat transfer, and cause no dye deposition after storage for three months in a high-temperature and high-humidity environment, in the case where high-speed printing is conducted with the increase of energy applied to the thermal head of a high-speed printer of sublimation transfer type.

Third Embodiment

The heat-sensitive transfer recording medium described in Patent Literature 3 set forth above exhibits high transfer sensitivity in a high-density portion of a print and thus is at a sufficiently high level. However, this heat-sensitive transfer recording medium suffers from a problem of insufficiency in the level of the transfer sensitivity in a low-density portion. Further, this heat-sensitive transfer recording medium also suffers from a problem of causing abnormal transfer when printing is conducted.

Thus, no heat-sensitive transfer recording medium has been developed in the conventional art, which can exhibit high transfer sensitivity in both of low- and high-density portions.

A third embodiment of the present invention can help to ameliorate or solve the above problem.

Hereinafter is described a third embodiment of the heat-sensitive transfer recording medium related to the present invention.

(General Configuration)

The heat-sensitive transfer recording medium related to the present embodiment has a structure similar to that of the heat-sensitive transfer recording medium 1 described in the first embodiment. Specifically, as shown in FIG. 1, the heat-sensitive transfer recording medium related to the present embodiment includes a base 10 having a surface on which a heat-resistant lubricating layer 20 is formed and the other surface on which an underlying layer 30 and a dye layer 40 are successively stacked and formed.

It should be noted that, compared to the first embodiment, the present embodiment is chiefly different in the quality of the material of the dye layer 40 but the rest remains unchanged. Accordingly, the description herein is focused on only the quality of the material of the dye layer 40 and description on the rest is omitted.

(Dye Layer 40)

The dye layer 40 of the present embodiment at least contains a polyvinyl acetal resin having a glass-transition temperature of not less than 100° C., and a polyvinyl butyral resin having a glass-transition temperature of not more than 75° C.

Use of the polyvinyl butyral resin having a glass-transition temperature of not more than 75° C. can provide an advantage of allowing easy sublimation of dye, and in particular, of raising transfer sensitivity in a portion in which print density is low. However, use of the polyvinyl butyral resin having a glass-transition temperature of not more than 75° C. alone raises a problem of slightly causing abnormal transfer. This is considered to be because single use of the polyvinyl butyral resin having a glass-transition temperature of not more than about 75° C. strengthens the adhesion with the image-receiving layer. On the other hand, the polyvinyl acetal resin having a glass-transition temperature of not less than about 100° C. does not easily allow sublimation of dye and does not ensure sufficient transfer sensitivity in a portion in which print density is low. The polyvinyl acetal resin having a glass-transition temperature of not less than about 100° C. ensures high stability of dye. Accordingly, it is considered that dye is not easily sublimated as far as a low gray-level portion is concerned, in which the energy applied to the thermal head is small. When the two types of resins mentioned above are used, abnormal transfer is prevented from occurring and transfer sensitivity is improved in a portion in which print density is low.

Example 3

Referring to FIG. 1, hereinafter are described some examples of manufacture of the heat-sensitive transfer recording medium 1 described in the third embodiment, and some comparative examples. The present invention should not be construed as being limited to the following examples.

First, the materials used for heat-sensitive transfer recording media of the respective examples of the present invention and of the respective comparative examples are shown. It should be noted that the term "parts" in the following description refers to a mass standard as far as no particular mention is made.

(Preparation of Base Having Heat-Resistant Lubricating Layer)

A surface-untreated polyethylene terephthalate film of 4.5 μm was used as the base 10. A heat-resistant lubricating layer coating solution having the following composition was coated onto one surface of the film by means of gravure coating so that a dry coating amount was 0.5 g/m$^2$, followed by drying at 100° C. for one minute, thereby preparing the base 10 on which the heat-resistant lubricating layer 20 was formed (base having a heat-resistant lubricating layer).

Heat-Resistant Lubricating Layer Coating Solution

| | |
|---|---|
| Silicon acrylate (US-350 of Toagosei Co., Ltd.) | 50.0 parts |
| MEK | 50.0 parts |

(Method of Preparing Sulfonic Group-Containing Polyester/Glycidyl Group-Containing Acryl Copolymer)

A four-necked flask having a distillation tube, a nitrogen inlet tube, a thermometer and an agitator was charged with dimethyl terephthalate by 854 parts, 5-sodium sulfo isophthalic acid by 355 parts, ethylene glycol by 186 parts and diethylene glycol by 742 parts, as well as zinc acetate by 1 part as a reactive catalyzer. The flask with the content was heated over two hours to 130° C. to 170° C. and then antimony trioxide was added by 1 part, followed by heating over two hours to 170° C. to 200° C. for esterification reaction.

Then, the flask with the content was gradually heated up, decompressed, followed by finally performing polycondensation over 1 to 2 hours at a reaction temperature of 250° C. and a vacuum of not more than 1 mmHg, thereby obtaining sulfonic group-containing polyester. Then, the resultant sulfonic group-containing polyester was dissolved into pure water, followed by adding glycidyl methacrylate, as a glycidyl group-containing acrylic monomer, so that a weight ratio of 30:70 in terms of polyester is achieved, further followed by adding potassium persulfate, as a polymerization initiator, thereby preparing a monomer emulsified liquid.

Then, a reaction container having a cooling tube was charged with pure water and the above monomer emulsified liquid, followed by blowing a nitrogen gas for 20 minutes for sufficient deoxidization. After that, the reaction container with the content was gradually heated over one hour, followed by three-hour reaction retaining 75° C. to 85° C., thereby obtaining a copolymer of sulfonic group-containing polyester and glycidyl group-containing acrylic. Further, the similar method was used for obtaining a copolymer of sulfonic group-containing polyester and carboxyl group-containing acrylic, as well as polyester/acrylic copolymers of respective polymerization ratios.

Example 3-1

The underlying layer 30 was formed by coating an underlying layer coating solution 3-1 of the following composition onto an untreated surface of a base having a heat-resistant lubricating layer by means of gravure coating, so that a dry coating amount was 0.20 g/m$^2$, followed by drying for two minutes at 100° C. Further, the dye layer 40 was formed by coating a dye layer coating solution 3-1 of the following composition onto the underlying layer 30 formed as above by means of gravure coating, so that a dry coating amount was 0.70 g/m$^2$, followed by drying for one minute at 90° C. Thus, the heat-sensitive transfer recording medium 1 of Example 3-1 was obtained.

Underlying Layer Coating Solution 3-1

| | |
|---|---|
| Sulfonic group-containing polyester/glycidyl group-containing acrylic copolymer (30:70) | 5.00 parts |
| Pure water | 47.5 parts |
| Isopropyl alcohol | 47.5 parts |

Dye Layer Coating Solution 3-1

| | |
|---|---|
| C.I. Solvent Blue-63 | 6.0 parts |
| #5000-D (polyvinyl acetal resin Tg = 110° C.) | 3.60 parts |
| #3000-1 (polyvinyl butyral resin Tg = 68° C.) | 0.40 parts |
| Polyvinyl acetal resin/polyvinyl butyral resin | 90/10 |
| Toluene | 45.0 parts |
| Methyl ethyl ketone | 45.0 parts |

Example 3-2

The heat-sensitive transfer recording medium 1 of Example 3-2 was obtained in a manner similar to that of Example 3-1, except that the underlying layer 30 was formed on an untreated surface of a base having a heat-resistant lubricating layer by coating an underlying layer coating solution 3-2 of the following composition.

Underlying Layer Coating Solution 3-2

| | |
|---|---|
| Sulfonic group-containing polyester/carboxyl group-containing acrylic copolymer (30:70) | 5.00 parts |
| Pure water | 47.5 parts |
| Isopropyl alcohol | 47.5 parts |

Example 3-3

The heat-sensitive transfer recording medium 1 of Example 3-3 was obtained in a manner similar to that of Example 3-1, except that the underlying layer 30 was formed on an untreated surface of a base having a heat-resistant lubricating layer by coating an underlying layer coating solution 3-3 of the following composition.

Underlying Layer Coating Solution 3-3

| | |
|---|---|
| Sulfonic group-containing polyester/glycidyl group-containing acrylic copolymer (20:80) | 5.00 parts |

-continued

| | |
|---|---|
| Pure water | 47.5 parts |
| Isopropyl alcohol | 47.5 parts |

Example 3-4

The heat-sensitive transfer recording medium 1 of Example 3-4 was obtained in a manner similar to that of Example 3-1, except that the underlying layer 30 was formed on an untreated surface of a base having a heat-resistant lubricating layer by coating an underlying layer coating solution 3-4 of the following composition.

Underlying Layer Coating Solution 3-4

| | |
|---|---|
| Sulfonic group-containing polyester/glycidyl group-containing acrylic copolymer (40:60) | 5.00 parts |
| Pure water | 47.5 parts |
| Isopropyl alcohol | 47.5 parts |

Example 3-5

The heat-sensitive transfer recording medium 1 of Example 3-5 was obtained in a manner similar to that of Example 3-1, except that the underlying layer coating solution 3-1 was coated onto an untreated surface of a base having a heat-resistant lubricating layer so that a dry coating amount of the underlying layer 30 was 0.03 g/m$^2$.

Example 3-6

The heat-sensitive transfer recording medium 1 of Example 3-6 was obtained in a manner similar to that of Example 3-1, except that the underlying layer coating solution 3-1 was coated onto an untreated surface of a base having a heat-resistant lubricating layer so that a dry coating amount of the underlying layer 30 was 0.35 g/m$^2$.

Example 3-7

The heat-sensitive transfer recording medium 1 of Example 3-7 was obtained in a manner similar to that of Example 3-1, except that the dye layer 40 was formed on the underlying layer 30 by coating a dye layer coating solution 3-2 of the following composition.

Dye Layer Coating Solution 3-2

| | |
|---|---|
| C.I. Solvent Blue-63 | 6.0 parts |
| #5000-D (polyvinyl acetal resin Tg = 110° C.) | 3.80 parts |
| #3000-1 (polyvinyl butyral resin Tg = 68° C.) | 0.20 parts |
| Polyvinyl acetal resin/polyvinyl butyral resin | 95/5 |
| Toluene | 45.0 parts |
| Methyl ethyl ketone | 45.0 parts |

Example 3-8

The heat-sensitive transfer recording medium 1 of Example 3-8 was obtained in a manner similar to that of Example 3-1, except that the dye layer 40 was formed on the underlying layer 30 by coating a dye layer coating solution 3-3 of the following composition.

Dye Layer Coating Solution 3-3

| | |
|---|---|
| C.I. Solvent Blue-63 | 6.0 parts |
| #5000-D (polyvinyl acetal resin Tg = 110° C.) | 3.88 parts |
| #3000-1 (polyvinyl butyral resin Tg = 68° C.) | 0.12 parts |
| Polyvinyl acetal resin/polyvinyl butyral resin | 97/3 |
| Toluene | 45.0 parts |
| Methyl ethyl ketone | 45.0 parts |

Example 3-9

The heat-sensitive transfer recording medium 1 of Example 3-9 was obtained in a manner similar to that of Example 3-1, except that the dye layer 40 was formed on the underlying layer 30 by coating a dye layer coating solution 3-4 of the following composition.

Dye Layer Coating Solution 3-4

| | |
|---|---|
| C.I. Solvent Blue-63 | 6.0 parts |
| #5000-D (polyvinyl acetal resin Tg = 110° C.) | 2.00 parts |
| #3000-1 (polyvinyl butyral resin Tg = 68° C.) | 2.00 parts |
| Polyvinyl acetal resin/polyvinyl butyral resin | 50/50 |
| Toluene | 45.0 parts |
| Methyl ethyl ketone | 45.0 parts |

Comparative Example 3-1

Without forming the underlying layer 30, the dye layer 40 was formed by coating a dye layer coating solution similar to that of Example 3-1 onto an untreated surface of a base having a heat-resistant lubricating layer by means of gravure coating, so that a dry coating amount was 0.70 g/m$^2$, followed by drying for one minute at 90° C., thereby obtaining the heat-sensitive transfer recording medium 1 of Comparative Example 3-1.

Comparative Example 3-2

The heat-sensitive transfer recording medium 1 of Comparative Example 3-2 was obtained in a manner similar to that of Example 3-1, except that the underlying layer 30 was formed on an untreated surface of a base having a heat-resistant lubricating layer by coating an underlying layer coating solution 3-7 of the following composition.

Underlying Layer Coating Solution 3-7

| | |
|---|---|
| Sulfonic group-containing polyester resin | 5.00 parts |
| Pure water | 47.5 parts |
| Isopropyl alcohol | 47.5 parts |

Comparative Example 3-3

The heat-sensitive transfer recording medium 1 of Comparative Example 3-3 was obtained in a manner similar to that of Example 3-1, except that the underlying layer 30 was formed on an untreated surface of a base having a heat-resistant lubricating layer by coating an underlying layer coating solution 3-8 of the following composition.

Underlying Layer Coating Solution 3-8

| | |
|---|---|
| Glycidyl group-containing acrylic resin | 5.00 parts |
| Pure water | 47.5 parts |
| Isopropyl alcohol | 47.5 parts |

Comparative Example 3-4

The heat-sensitive transfer recording medium 1 of Comparative Example 3-4 was obtained in a manner similar to that of Example 3-1, except that the underlying layer 30 was formed on an untreated surface of a base having a heat-resistant lubricating layer by coating an underlying layer coating solution 3-9 of the following composition.

Underlying Layer Coating Solution 3-9

| | |
|---|---|
| Carboxyl group-containing acrylic resin | 5.00 parts |
| Pure water | 47.5 parts |
| Isopropyl alcohol | 47.5 parts |

Comparative Example 3-5

The heat-sensitive transfer recording medium 1 of Comparative Example 3-5 was obtained in a manner similar to that of Example 3-1, except that the underlying layer 30 was formed on an untreated surface of a base having a heat-resistant lubricating layer by coating an underlying layer coating solution 3-10 of the following composition.

Underlying Layer Coating Solution 3-10

| | |
|---|---|
| Glycidyl group-containing acrylic resin | 7.00 parts |
| Sulfonic group-containing polyester resin | 3.00 parts |
| Pure water | 45.0 parts |
| Isopropyl alcohol | 45.0 parts |

Comparative Example 3-6

The heat-sensitive transfer recording medium 1 of Comparative Example 3-6 was obtained in a manner similar to that of Example 3-1, except that the underlying layer 30 was formed on an untreated surface of a base having a heat-resistant lubricating layer by coating an underlying layer coating solution 3-11 of the following composition.

Underlying Layer Coating Solution 3-11

| | |
|---|---|
| Alumina sol | 5.00 parts |
| Polyvinyl alcohol | 5.00 parts |
| Pure water | 45.0 parts |
| Isopropyl alcohol | 45.0 parts |

Comparative Example 3-7

The heat-sensitive transfer recording medium 1 of Comparative Example 3-7 was obtained in a manner similar to that of Example 3-1, except that the dye layer 40 was formed on the underlying layer 30 by coating a dye layer coating solution 3-5 of the following composition.

Dye Layer Coating Solution 3-5

| | |
|---|---|
| C.I. Solvent Blue-63 | 6.0 parts |
| #3000-1 (polyvinyl butyral resin Tg = 68° C.) | 4.00 parts |
| Polyvinyl acetal resin/polyvinyl butyral resin | 0/100 |
| Toluene | 45.0 parts |
| Methyl ethyl ketone | 45.0 parts |

Comparative Example 3-8

The heat-sensitive transfer recording medium 1 of Comparative Example 3-8 was obtained in a manner similar to that of Example 3-1, except that the dye layer 40 was formed on the underlying layer 30 by coating a dye layer coating solution 3-6 of the following composition.

Dye Layer Coating Solution 3-6

| | |
|---|---|
| C.I. Solvent Blue-63 | 6.0 parts |
| #5000-D (polyvinyl acetal resin Tg = 110° C.) | 4.00 parts |
| Polyvinyl acetal resin/polyvinyl butyral resin | 100/0 |
| Toluene | 45.0 parts |
| Methyl ethyl ketone | 45.0 parts |

(Preparation of Object to be Transferred)

A white-foam polyethylene terephthalate film of 188 μm was used as the base 10 to prepare an object to be transferred for heat-sensitive transfer by coating an image-receiving layer coating solution of the following composition onto one surface of the film by means of gravure coating so that a dry coating amount was 5.0 g/m$^2$, followed by drying.

Image-Receiving Layer Coating Solution

| | |
|---|---|
| Vinyl chloride/vinyl acetate/vinyl alcohol copolymer | 19.5 parts |
| Amino-modified silicone oil | 0.5 parts |

-continued

| | |
|---|---|
| Toluene | 40.0 parts |
| Methyl ethyl ketone | 40.0 parts |

(Evaluation on Printing)

Printing was performed by means of a thermal simulator on the heat-sensitive transfer recording media 1 of Examples 3-1 to 3-9 and Comparative Examples 3-1 to 3-6 to evaluate maximum reflection density and also to evaluate reflection density of individual gray levels of 11 divisions of 255-level grayscale that corresponds to the highest reflection density. The results of the evaluation are shown in Tables 3 and 4. It should be noted that the maximum reflection density corresponds to a value obtained by measuring a printed portion, in which no abnormal transfer is observed, by means of X-Rite 528.

Printing conditions are as follows.

Printing Conditions

Printing environment: 23° C.50% RH

Applied voltage: 29 V

Line period: 0.7 msec

Print density: Horizontal scan 300 dpi, Vertical scan 300 dpi (Evaluation on Abnormal Transfer)

Evaluation on abnormal transfer was conducted along the line set forth below. It should be noted that a level of Δ○ or more involves no practical problem.

○: No abnormal transfer to an object to be transferred observed.

Δ○: Abnormal transfer to an object to be transferred observed quite slightly.

Δ: Abnormal transfer to an object to be transferred slightly observed.

X: Abnormal transfer to an object to be transferred observed throughout the whole surface.

TABLE 3

| | Dry coating amount of underlying layer [g/m$^2$] | Polyester-acryl copolymerization ratio (weight ratio) | | | Content ratio of polyvinyl acetal resin and polyvinyl butyral resin | | Maximum reflection density 255/255 | Abnormal transfer |
|---|---|---|---|---|---|---|---|---|
| | | Sulfonic group-containing polyester | Glycidyl group-containing acryl | Carboxyl group-containing acryl | Polyvinyl acetal resin | Polyvinyl butyral resin | | |
| Example 3-1 | 0.20 | 30 | 70 | — | 90 | 10 | 2.44 | ○ |
| Example 3-2 | 0.20 | 30 | — | 70 | 90 | 10 | 2.42 | ○ |
| Example 3-3 | 0.20 | 20 | 80 | — | 90 | 10 | 2.48 | Δ○ |
| Example 3-4 | 0.20 | 40 | 60 | — | 90 | 10 | 2.42 | ○ |
| Example 3-5 | 0.03 | 30 | 70 | — | 90 | 10 | 2.39 | Δ○ |
| Example 3-6 | 0.35 | 30 | 70 | — | 90 | 10 | 2.45 | ○ |
| Example 3-7 | 0.20 | 30 | 70 | | 95 | 5 | 2.45 | ○ |
| Example 3-8 | 0.20 | 30 | 70 | — | 97 | 3 | 2.45 | ○ |
| Example 3-9 | 0.20 | 30 | 70 | | 50 | 50 | 2.42 | Δ○ |
| Comparative Example 3-1 | — | — | — | — | 90 | 10 | 1.83 | X |
| Comparative Example 3-2 | 0.20 | 100 | — | — | 90 | 10 | 1.99 | ○ |
| Comparative Example 3-3 | 0.20 | — | 100 | — | 90 | 10 | 2.48 | X |
| Comparative Example 3-4 | 0.20 | — | — | 100 | 90 | 10 | 2.46 | X |
| Comparative Example 3-5 | 0.20 | Polyester/glycidyl group-containing acryl blend (30/70) | | | 90 | 10 | 2.23 | X |
| Comparative Example 3-6 | 0.20 | Alumina sol/polyvinyl alcohol | | | 90 | 10 | 2.38 | Δ |
| Comparative Example 3-7 | 0.20 | 30 | 70 | — | 0 | 100 | 2.42 | Δ |

TABLE 3-continued

| | Dry coating amount of underlying layer [g/m$^2$] | Polyester-acryl copolymerization ratio (weight ratio) | | | Content ratio of polyvinyl acetal resin and polyvinyl butyral resin | | Maximum reflection density 255/255 | Abnormal transfer |
|---|---|---|---|---|---|---|---|---|
| | | Sulfonic group-containing polyester | Glycidyl group-containing acryl | Carboxyl group-containing acryl | Polyvinyl acetal resin | Polyvinyl butyral resin | | |
| Comparative Example 3-8 | 0.20 | 30 | 70 | — | 100 | 0 | 2.46 | ○ |

TABLE 4

| Gray level | 0 | 23/255 | 46/255 | 70/255 | 93/255 | 116/255 | 139/255 | 162/255 | 185/255 | 209/255 | 232/255 | 255/255 |
|---|---|---|---|---|---|---|---|---|---|---|---|---|
| Ex. 3-1 | 0.06 | 0.10 | 0.22 | 0.36 | 0.47 | 0.67 | 0.92 | 1.19 | 1.49 | 1.70 | 2.08 | 2.44 |
| Ex. 3-2 | 0.06 | 0.10 | 0.22 | 0.36 | 0.47 | 0.67 | 0.91 | 1.18 | 1.48 | 1.68 | 2.06 | 2.42 |
| Ex. 3-3 | 0.06 | 0.10 | 0.22 | 0.37 | 0.48 | 0.68 | 0.94 | 1.21 | 1.51 | 1.73 | 2.11 | 2.48 |
| Ex. 3-4 | 0.06 | 0.10 | 0.22 | 0.36 | 0.47 | 0.67 | 0.91 | 1.18 | 1.47 | 1.67 | 2.06 | 2.42 |
| Ex. 3-5 | 0.06 | 0.10 | 0.23 | 0.36 | 0.47 | 0.65 | 0.90 | 1.16 | 1.45 | 1.66 | 2.03 | 2.39 |
| Ex. 3-6 | 0.06 | 0.10 | 0.20 | 0.36 | 0.47 | 0.67 | 0.92 | 1.20 | 1.50 | 1.71 | 2.09 | 2.45 |
| Ex. 3-7 | 0.06 | 0.10 | 0.20 | 0.34 | 0.46 | 0.66 | 0.90 | 1.18 | 1.49 | 1.70 | 2.09 | 2.45 |
| Ex. 3-8 | 0.06 | 0.09 | 0.18 | 0.33 | 0.45 | 0.65 | 0.89 | 1.17 | 1.48 | 1.70 | 2.09 | 2.45 |
| Ex. 3-9 | 0.06 | 0.11 | 0.23 | 0.37 | 0.49 | 0.70 | 0.94 | 1.20 | 1.49 | 1.69 | 2.06 | 2.42 |
| Con. Ex. 3-1 | 0.06 | 0.11 | 0.23 | 0.38 | 0.47 | 0.64 | 0.86 | 1.11 | 1.37 | 1.56 | 1.76 | 1.83 |
| Con. Ex. 3-2 | 0.06 | 0.09 | 0.18 | 0.29 | 0.39 | 0.55 | 0.75 | 0.97 | 1.21 | 1.39 | 1.69 | 1.99 |
| Con. Ex. 3-3 | 0.06 | 0.10 | 0.22 | 0.37 | 0.48 | 0.68 | 0.94 | 1.21 | 1.51 | 1.73 | 2.11 | 2.48 |
| Con. Ex. 3-4 | 0.06 | 0.10 | 0.22 | 0.37 | 0.48 | 0.68 | 0.93 | 1.20 | 1.50 | 1.71 | 2.09 | 2.46 |
| Con. Ex. 3-5 | 0.06 | 0.09 | 0.20 | 0.33 | 0.43 | 0.61 | 0.84 | 1.09 | 1.36 | 1.55 | 1.90 | 2.23 |
| Con. Ex. 3-6 | 0.06 | 0.10 | 0.21 | 0.35 | 0.46 | 0.65 | 0.90 | 1.16 | 1.45 | 1.66 | 2.03 | 2.38 |
| Con. Ex. 3-7 | 0.07 | 0.12 | 0.25 | 0.39 | 0.52 | 0.72 | 0.97 | 1.23 | 1.50 | 1.70 | 2.07 | 2.42 |
| Con. Ex. 3-8 | 0.06 | 0.07 | 0.16 | 0.31 | 0.42 | 0.61 | 0.87 | 1.15 | 1.47 | 1.69 | 2.07 | 2.46 |

From the results shown in Table 3, it was demonstrated that high sensitivity was exhibited in high-speed printing by the heat-sensitive transfer recording media 1 of Examples 3-1 to 3-9 (the heat-sensitive transfer recording media 1 in each of which the underlying layer 30 was formed, containing a copolymer of sulfonic group-containing polyester and glycidyl group- or carboxyl group-containing acrylic, and the dye layer 40 was formed, containing the polyvinyl acetal resin having a glass-transition temperature of not less than 100° C. and the polyvinyl butyral resin having a glass-transition temperature of not more than 75° C.), compared to Comparative Example 3-1 provided with no underlying layer 30 and Comparative Example 3-2 whose underlying layer 30 was comprised of sulfonic group-containing polyester alone. Further, no abnormal transfer was observed in Examples 1-3 to 3-9 in each of which a surface-untreated base was used.

It was demonstrated that transfer sensitivity was high in high-speed printing in Comparative Example 3-3 whose under lying layer 30 was comprised of glycidyl group-containing acrylic alone, Comparative Example 3-4 whose underlying layer 30 was comprised of carboxyl group-containing acrylic alone, and Comparative Example 3-6 whose underlying layer 30 was comprised of alumina sol/polyvinyl alcohol alone. However, a little abnormal transfer was observed in these comparative examples. Further, in Comparative Example 3-2 whose underlying layer 30 was comprised of sulfonic group-containing polyester alone, no abnormal transfer was observed, although transfer sensitivity in high-speed printing was low.

In Comparative Example 3-5 containing a blend of sulfonic group-containing polyester and glycidyl group-containing acrylic at 30:70 (ratio in terms of mass standard), transfer sensitivity was low and abnormal transfer was observed as well. From the comparison with Example 3-1, it is understood that good results are obtained by copolymerizing sulfonic group-containing polyester and glycidyl group-containing acrylic.

Further, compared to the heat-sensitive transfer recording medium 1 of Example 3-1, in Example 3-5, in which the coating amount of the underlying layer 30 was less than 0.05 g/m$^2$, lowering was observed to some extent in transfer sensitivity and adhesiveness. Similarly, compared to the heat-sensitive transfer recording medium 1 of Example 3-1, in Example 3-6, in which the coating amount of the underlying layer 30 was more than 0.30 g/m$^2$, transfer sensitivity and adhesiveness were demonstrated to be substantially the same.

From the results shown in Tables 3 and 4, it was demonstrated that higher transfer sensitivity was exhibited in high-speed printing by low density portions of the heat-sensitive transfer recording media 1 of Examples 3-1 to 3-9 in each of which the dye layer 40 contained the polyvinyl acetal resin having a glass-transition temperature of not less than about 100° C. and the polyvinyl butyral resin having a glass-transition temperature of not more than about 75° C., compared to the heat-sensitive transfer recording medium 1 of Comparative Example 3-8 that did not contain the polyvinyl butyral resin having a glass-transition temperature of not more than about 75° C. Further, it was also demonstrated that color density was effectively increased in the low density portions when the ratio of the polyvinyl acetal resin having a glass-transition temperature of not less than about 100° C.: the polyvinyl butyral resin having a glass-transition temperature of not more than about 75° C.=97:3.

As the content ratio of the polyvinyl butyral resin having a glass-transition temperature of not more than about 75° C. was higher, transfer sensitivity was higher in the low density portions. However, abnormal transfer was caused slightly in the heat-sensitive transfer recording medium 1 of Comparative Example 3-7 that contained only the polyvinyl butyral resin having a glass-transition temperature of not more than about 75° C.

As described above, the heat-sensitive transfer recording medium 1 of the present embodiment is able to improve adhesiveness, dye barrier properties and solvent resistance of the underlying layer 30 with respect to the base 10 and the dye layer 40, while improving transfer sensitivity of the dye layer 40 with respect to an object to be transferred. Accordingly, with this heat-sensitive transfer recording medium 1, the occurrence of abnormal transfer is suppressed when high-speed printing is conducted with the increase of energy applied to the thermal head provided to an existing high-speed printer of sublimation transfer type, and high transfer sensitivity is ensured when print density is low or high.

Fourth Embodiment

Besides the problems discussed above, the technical field related to the present invention has been facing another problem of short life of a thermal head when used in a high-speed printer, due to the application of lots of energy in a short time to the thermal head of the printer, which imposes a large load to the thermal head. Further, still another problem that the technical field has faced is the occurrence of unevenness in a printed matter, which is induced by the uneven thermal conduction of the thermal head.

In order to cope with these requests, some methods have been proposed. For example, in a proposal, a heat-sensitive transfer recording medium includes a heat-resistant lubricating layer that contains a surfactant of alkane sulfonate sodium salt type, as a lubricant, and contains a filler having a Mohs hardness of not more than 4 that is 1.8 folds or more of the true specific gravity of the binder, to thereby improve durability and attain maintenance free in a thermal head. (For example, see JP-A-2008-188968).

However, when printing was conducted using the heat-sensitive transfer recording medium described in JP-A-2008-188968 and using an existing high-speed printer of sublimation transfer type, unevenness was observed in the printed matters with the increase of the volume of prints, although no stain was observed in the thermal head. The unevenness, which was not observed in the initial stage of printing, was attributed to uneven thermal conduction that was caused by the wear of the thermal head.

A fourth embodiment of the present invention can solve the problem set forth above.

Hereinafter is described a fourth embodiment of the heat-sensitive transfer recording medium related to the present invention.

(General Configuration)

Figure 2:
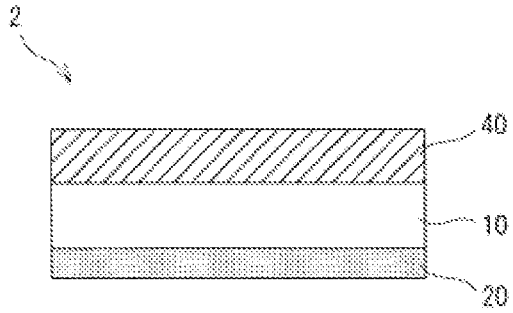
FIG. 2 is a diagram illustrating a schematic configuration of a heat-sensitive transfer recording medium of a fourth embodiment of the present invention.

FIG. 2 is a diagram illustrating a schematic configuration of a heat-sensitive transfer recording medium of the present embodiment, the diagram being a cross section of the heat-sensitive transfer recording medium as viewed from a lateral side.

As shown in FIG. 2, a heat-sensitive transfer recording medium 2 includes a base 10 formed into a shape of a film, a heat-resistant lubricating layer 20 formed on one of both surfaces of the base 10, and a dye layer 40 formed on the other surface of the base 10.

It should be noted that the base 10 may be given with an adhesion treatment on the surface on which the heat-resistant lubrication layer 20 is formed (lower surface in the figure) and the surface on which the dye layer 40 is formed (upper surface in the figure). The adhesion treatment may be given to either one or both of the surfaces.

A known technique, such as corona treatment, flame treatment, ozone treatment, ultraviolet treatment, radiation treatment, rough surface treatment, plasma treatment or primer treatment may be applied to the adhesion treatment. These treatments may be used in combination of two or more.

In the present embodiment, enhancing adhesiveness between the base 10 and the dye layer 40 is effective, as a preferred example, and thus a primer-treated polyethylene terephthalate film may be used, from a viewpoint of cost as well.

Further, a layer may be provided between the base 10 and the dye layer 40 or between the base 10 and the heat-resistant lubricating layer 20 for the purpose of imparting functionality, such as improvement of adhesiveness or improvement of dye usage efficiency.

The base 10 and the dye layer 40 included in the heat-sensitive transfer recording medium 2 related to the present embodiment have configurations similar to those of the base 10 and the dye layer 40 described in the first embodiment. Accordingly, description herein is focused on the heat-resistant lubricating layer 20 alone, and description on the rest is omitted.

(Configuration of Heat-Resistant Lubricating Layer 20)

The heat-resistant lubricating layer 20 is a layer which is formed on one side of the base 10 and gives lubricity to the heat-sensitive transfer recording medium 2 relative to a thermal head. The heat-resistant lubricating layer 20 of the present embodiment at least contains: a binder that is comprised of a thermoplastic resin or a reactant of a thermoplastic resin and a polyisocyanate, or comprised of a radical reactant that is triggered by ultraviolet rays or electronic rays; an inorganic material having cleavage; and spherical particles. The inorganic material has a true specific gravity that is in a range of not less than about 2.1 folds to not more than about 3 folds of that of the binder. The spherical particles have an average particle size that is in a range of not less than about 0.4 folds to not more than about 2 folds of the thickness of the heat-resistant lubricating layer 20, and have a true specific gravity of not more than about 1.4 folds of that of the binder.

Removal of stains from a thermal head as well as reduction of wear of the thermal head can be achieved by having the heat-resistant lubricating layer 20 contained at least the binder comprised of a thermoplastic resin or a reactant of a thermoplastic resin and a polyisocyanate, the inorganic material having cleavage and having a true specific gravity in a range of not less than about 2.1 folds to not more than about 3 folds of that of the binder, and the spherical particles having an average particle size that is in a range of not less than about 0.4 folds to not more than about 2 folds of the thickness of the heat-resistant lubricating layer 30, and having a true specific gravity of not more than about 1.4 folds of that of the binder.

The inorganic material having cleavage easily turns to a tabular powder due to its characteristics, and resultantly enables removal of stains from throughout a thermal head. However, when the true specific gravity of the inorganic material is less than 2.1 folds of the true specific gravity of the binder, the inorganic material has an exceedingly high probability of being present in a surface layer portion of the heat-resistant lubricating layer 20, becoming a factor of causing wear in the thermal head. Further, when the true specific gravity of the inorganic material exceeds three folds of the true specific gravity of the binder, the inorganic material has an exceedingly low probability of being present in the surface layer portion of the heat-resistant lubricating layer 20, leading to insufficient removal of stains from the thermal head.

The spherical particles reduce the contact area between the thermal head and the heat-resistant lubricating layer 20 to enable reduction of wear in the thermal head. However, when the average particle size of the spherical particles exceeds two folds of the thickness of the heat-resistant lubricating layer 20, the spherical particles tend to drop off and thus the effect is reduced. Further, when the average particle size of the spherical particles is less than 0.4 folds of the thickness of the heat-resistant lubricating layer 20, or the true specific gravity of the spherical particles exceeds 1.4 folds of the true specific gravity of the binder, the contact area between the thermal head and the heat-resistant lubricating layer 20 cannot be sufficiently reduced and thus the effect is reduced.

The heat-resistant lubricating layer 20 can be prepared, for example, by preparing a heat-resistant lubricating layer forming coating solution by blending, as necessary, a functional additive for imparting releasability or lubricity, a filler, a curative, a solvent and the like, with a resin as the binder, the inorganic material having cleavage, and the spherical particles, and coating the prepared coating solution onto one surface of the base 10, followed by drying.

It should be noted that the binder resin, functional additive, curative, filler and curative are the same as the binder resin, functional additive, curative, filler and curative, respectively, contained in the heat-resistant lubricating layer 20 described in the first embodiment. Therefore, description of these is omitted herein.

The inorganic material having cleavage used can include fluorite, calcite, dolomite, graphite, hausmannite, gibbsite, brucite, pyrophyllite, talc, kaolinite, chlorite, montmorillonite, or the like, as far as the a true specific gravity ranges from not less than about 2.1 folds to not more than about 3 folds of the true specific gravity of the binder. The inorganic material to be used may be ground as necessary.

Desirably, the inorganic material having cleavage is perfect in one direction. A material having a perfect cleavage in one direction can easily retain a tabular form and therefore is effective in reducing wear in the thermal head and removing stains therefrom.

Further, desirably, the content of the inorganic material having cleavage is within a range of not less than about 2 mass % to not more than about 10 mass % with respect to the heat-resistant lubricating layer 20. If the content of the inorganic material is less than 2 mass %, the stains of the thermal head cannot be sufficiently removed. If the content of the inorganic material exceeds 10 mass %, the wear of the thermal head tends to become large.

The spherical particles used can include, as appropriate: an organic material, such as, silicone resin, silicone rubber, fluorine resin, acrylic resin, polystyrene resin, or polyethylene resin; or an organic-inorganic composite material, as far as the true specific gravity is not more than about 1.4 folds of the true specific gravity of the binder.

Further, desirably, the content of the spherical particles ranges from not less than about 0.5 mass % to not more than about 2 mass % relative to the heat-resistant lubricating layer 20. If the content of the spherical particles is less than 0.5 mass %, it is difficult to sufficiently reduce the wear of the thermal head. If the content of the spherical particles exceeds 2 mass %, removal of the stains from the thermal head is likely to be hindered.

Example 4

Referring to FIG. 2, hereinafter are described some examples of manufacture of the heat-sensitive transfer recording medium 2 described in the fourth embodiment, and some comparative examples. The present invention should not be construed as being limited to the following examples.

First, the materials used for the heat-sensitive transfer recording media of the respective examples of the present invention and of the respective comparative examples are shown. It should be noted that the term "parts" in the following description refers to a mass standard as far as no particular mention is made.

In the following examples and comparative examples, an object to be transferred for heat transfer was prepared using a method provided below.

(Preparation of Object to be Transferred)

A double sided resin-coated paper of 190 μm was used as the base 10. A heat-resistant lubricating layer coating solution having the following composition was coated onto one surface of the paper by means of dye coating so that a dry coating amount was 8.0 g/m$^2$, followed by drying, thereby preparing a heat-insulating layer. After that, a receiving layer coating solution having the following composition was coated onto an upper surface of the heat-insulating layer by means of gravure coating so that a dry coating amount was 4.0 g/m$^2$, followed by drying. Thus, an object to be transferred for heat transfer was prepared.

Heat-Insulating Layer Coating Solution

| | |
|---|---|
| Acryl-styrene hollow particles (Average particle size 1 μm, volumetric hollow rate 51%) | 35.0 parts |
| Styrene-butadiene rubber | 10.0 parts |
| Pure water | 55.0 parts |
| Dispersant | Very small quantity |
| Antifoam agent | Very small quantity |

Image-Receiving Layer Coating Solution

| | |
|---|---|
| Vinyl chloride/vinyl acetate/vinyl alcohol copolymer | 19.5 parts |
| Amino-modified silicone oil | 0.5 parts |
| Toluene | 40.0 parts |
| Methyl ethyl ketone | 40.0 parts |

Example 4-1

A polyethylene terephthalate film having a thickness of 4.5 μm, whose one surface was easy-adhesion-treated, was used as the base 10. A heat-resistant lubricating layer coating solution 4-1 having the following composition was coated onto a non-easy-adhesion-treated surface of the film by means of gravure coating so that a dry coating amount was 0.5 g/m$^2$. Then, the heat-resistant lubricating layer coating solution 4-1 coated onto the non-easy-adhesion-treated surface of the base 10 was dried at 100° C. for one minute, thereby forming the heat-resistant lubricating layer 20.

Then, a dye layer coating solution 4-1 having the following composition was coated onto the easy-adhesion-treated surface of the base 10 on which the heat-resistant lubricating layer 20 was formed, by means of gravure coating so that a dry coating amount was 0.70 g/m$^2$. After that, the dye layer coating solution 4-1 coated onto the easy-adhesion-treated surface of the base 10 was dried at 90° C. for one minute, thereby forming the dye layer 40. Thus, the heat-sensitive transfer recording medium 2 of Example 4-1 was obtained.

In Example 4-1, the particle size of the spherical particles was 1.1 folds of the coating amount of the heat-resistant lubricating layer 20, and the true specific gravity of the spherical particles was 1.36 folds of that of the binder. Further, the inorganic material had a perfect cleavage in one direction, and had a true specific gravity that was 2.46 folds of the true specific gravity of the binder.

Heat-Resistant Lubricating Layer Coating Solution 4-1

| | |
|---|---|
| Butyral resin (True specific gravity 1.1) | 22.2 parts |
| Melamine-formaldehyde condensate spherical particles | 0.3 parts |
| (True specific gravity 1.5, Particle size 0.5 μm) | |
| Mica | 1.5 parts |
| (True specific gravity 2.9, Perfect cleavage in one direction) | |
| Zinc stearate | 6.0 parts |
| MEK | 40.0 parts |
| Toluene | 30.0 parts |

Dye Layer Coating Solution 4-1

| | |
|---|---|
| C.I. Solvent Blue-63 | 6.0 parts |
| Polyvinyl acetal resin | 4.0 parts |
| Toluene | 45.0 parts |
| Methyl ethyl ketone | 45.0 parts |

Example 4-2

The heat-sensitive transfer recording medium 2 of Example 4-2 was obtained in a manner similar to that of Example 4-1, except that the heat-resistant lubricating layer 20 was formed using a heat-resistant lubricating layer coating solution 4-2 of the following composition.

In Example 4-2, the particle size of the spherical particles was 1.8 folds of the coating amount of the heat-resistant lubricating layer 20, and the true specific gravity of the spherical particles was 1.3 folds of that of the binder. Further, the inorganic material had a perfect cleavage in one direction, and had a true specific gravity that was 2.2 folds of the true specific gravity of the binder.

Heat-Resistant Lubricating Layer Coating Solution 4-2

| | |
|---|---|
| Polystyrene resin (True specific gravity 1.2) | 22.2 parts |
| Silicone resin spherical particles | 0.3 parts |
| (True specific gravity 1.3, Particle size 0.8 μm) | |
| Graphite | 1.5 parts |
| (True specific gravity 2.2, Perfect cleavage in on direction) | |
| Zinc stearate | 6.0 parts |
| MEK | 40.0 parts |
| Toluene | 30.0 parts |

Example 4-3

The heat-sensitive transfer recording medium 2 of Example 4-3 was obtained in a manner similar to that of Example 4-1, except that the heat-resistant lubricating layer 20 was formed using a heat-resistant lubricating layer coating solution 4-3 of the following composition.

In Example 4-3, the particle size of the spherical particles was 1.8 folds of the coating amount of the heat-resistant lubricating layer 20, and the true specific gravity of the spherical particles was 1.3 folds of that of the binder. Further, the inorganic material had a perfect cleavage in one direction, and had a true specific gravity that was 2.91 folds of the true specific gravity of the binder.

Heat-Resistant Lubricating Layer Coating Solution 4-3

| | |
|---|---|
| Butyral resin (True specific gravity 1.1) | 22.2 parts |
| Silicone resin spherical particles | 0.3 parts |
| (True specific gravity 1.3, Particle size 0.8 μm) | |
| Chlorite | 1.5 parts |
| (True specific gravity 3.2, Perfect cleavage in one direction) | |
| Zinc stearate | 6.0 parts |
| MEK | 40.0 parts |
| Toluene | 30.0 parts |

Example 4-4

The heat-sensitive transfer recording medium 2 of Example 4-4 was obtained in a manner similar to that of Example 4-1, except that the heat-resistant lubricating layer 20 was formed using a heat-resistant lubricating layer coating solution 4-4 of the following composition.

In Example 4-4, the particle size of the spherical particles was 1.8 folds of the coating amount of the heat-resistant lubricating layer 20, and the true specific gravity of the spherical particles was 1.3 folds of that of the binder. Further, the inorganic material had a perfect cleavage in one direction, and had a true specific gravity that was 2.91 folds of the true specific gravity of the binder.

Heat-Resistant Lubricating Layer Coating Solution 4-4

| | |
|---|---|
| Butyral resin (True specific gravity 1.1) | 22.2 parts |
| Silicone resin spherical particles | 0.3 parts |
| (True specific gravity 1.3, Particle size 0.8 μm) | |
| Fluorite | 1.5 parts |
| (True specific gravity 3.2, Perfect cleavage in one direction) | |
| Zinc stearate | 6.0 parts |
| MEK | 40.0 parts |
| Toluene | 30.0 parts |

Example 4-5

The heat-sensitive transfer recording medium 2 of Example 4-5 was obtained in a manner similar to that of Example 4-1, except that the heat-resistant lubricating layer coating solution 4-1 used in Example 4-1 was coated so that a dry coating amount was 0.3 g/m$^2$.

In Example 4-5, the particle size of the spherical particles was 1.9 folds of the coating amount of the heat-resistant lubricating layer 20, and the true specific gravity of the spherical particles was 1.36 folds of that of the binder. Further, the inorganic material had a perfect cleavage in one direction, and had a true specific gravity that was 2.64 folds of the true specific gravity of the binder.

Example 4-6

The heat-sensitive transfer recording medium 2 of Example 4-6 was obtained in a manner similar to that of Example 4-1, except that the heat-resistant lubricating layer coating solution 4-1 used in Example 4-1 was coated so that a dry coating amount was 1.2 g/m$^2$.

In Example 4-6, the particle size of the spherical particles was 0.5 folds of the coating amount of the heat-resistant lubricating layer 20, and the true specific gravity of the spherical particles was 1.36 folds of that of the binder. Further, the inorganic material had a perfect cleavage in one direction, and had a true specific gravity that was 2.64 folds of the true specific gravity of the binder.

Example 4-7

The heat-sensitive transfer recording medium 2 of Example 4-7 was obtained in a manner similar to that of Example 4-1, except that the heat-resistant lubricating layer 20 was formed using a heat-resistant lubricating layer coating solution 4-5 of the following composition.

In Example 4-7, the particle size of the spherical particles was 1.1 folds of the coating amount of the heat-resistant lubricating layer 20, and the true specific gravity of the spherical particles was 1.36 folds of that of the binder. Further, the inorganic material had a perfect cleavage in one direction, and had a true specific gravity that was 2.64 folds of the true specific gravity of the binder.

Heat-Resistant Lubricating Layer Coating Solution 4-5

| | |
|---|---|
| Butyral resin (True specific gravity 1.1) | 22.3 parts |
| Melamine-formaldehyde condensate spherical particles (True specific gravity 1.5, Particle size 0.5 μm) | 0.2 parts |
| Mica (True specific gravity 2.9, Perfect cleavage in one direction) | 1.5 parts |
| Zinc stearate | 6.0 parts |
| MEK | 40.0 parts |
| Toluene | 30.0 parts |

Example 4-8

The heat-sensitive transfer recording medium 2 of Example 4-8 was obtained in a manner similar to that of Example 4-1, except that the heat-resistant lubricating layer 20 was formed using a heat-resistant lubricating layer coating solution 4-6 of the following composition.

In Example 4-8, the particle size of the spherical particles was 1.1 folds of the coating amount of the heat-resistant lubricating layer 20, and the true specific gravity of the spherical particles was 1.36 folds of that of the binder. Further, the inorganic material had a perfect cleavage in one direction, and had a true specific gravity that was 2.64 folds of the true specific gravity of the binder.

Heat-Resistant Lubricating Layer Coating Solution 4-6

| | |
|---|---|
| Butyral resin (True specific gravity 1.1) | 22.5 parts |
| Melamine-formaldehyde condensate spherical particles (True specific gravity 1.5, Particle size 0.5 μm) | 0.6 parts |
| Mica (True specific gravity 2.9, Perfect cleavage in one direction) | 1.5 parts |
| Zinc stearate | 6.0 parts |
| MEK | 39.4 parts |
| Toluene | 30.0 parts |

Example 4-9

The heat-sensitive transfer recording medium 2 of Example 4-9 was obtained in a manner similar to that of Example 4-1, except that the heat-resistant lubricating layer 20 was formed using a heat-resistant lubricating layer coating solution 4-7 of the following composition.

In Example 4-9, the particle size of the spherical particles was 1.1 folds of the coating amount of the heat-resistant lubricating layer 20, and the true specific gravity of the spherical particles was 1.36 folds of that of the binder. Further, the inorganic material had a perfect cleavage in one direction, and had a true specific gravity that was 2.64 folds of the true specific gravity of the binder.

Heat-Resistant Lubricating Layer Coating Solution 4-7

| | |
|---|---|
| Butyral resin (True specific gravity 1.1) | 23 parts |
| Melamine-formaldehyde condensate spherical particles (True specific gravity 1.5, Particle size 0.5 μm) | 0.3 parts |
| Mica (True specific gravity 2.9, Perfect cleavage in one direction) | 0.7 parts |
| Zinc stearate | 6.0 parts |
| MEK | 40.0 parts |
| Toluene | 30.0 parts |

Example 4-10

The heat-sensitive transfer recording medium 2 of Example 4-10 was obtained in a manner similar to that of Example 4-1, except that the heat-resistant lubricating layer 20 was formed using a heat-resistant lubricating layer coating solution 4-8 of the following composition.

In Example 4-10, the particle size of the spherical particles was 1.1 folds of the coating amount of the heat-resistant lubricating layer 20, and the true specific gravity of the spherical particles was 1.36 folds of that of the binder. Further, the inorganic material had a perfect cleavage in one direction, and had a true specific gravity that was 2.64 folds of the true specific gravity of the binder.

Heat-Resistant Lubricating Layer Coating Solution 4-8

| | |
|---|---|
| Butyral resin (True specific gravity 1.1) | 20.9 parts |
| Melamine-formaldehyde condensate spherical particles (True specific gravity 1.5, Particle size 0.5 μm) | 0.3 parts |
| Mica (True specific gravity 2.9, Perfect cleavage in one direction) | 2.8 parts |
| Zinc stearate | 6.0 parts |
| MEK | 40.0 parts |
| Toluene | 30.0 parts |

Example 4-11

The heat-sensitive transfer recording medium 2 of Example 4-11 was obtained in a manner similar to that of Example 4-1, except that the heat-resistant lubricating layer 20 was formed using a heat-resistant lubricating layer coating solution 4-9 of the following composition.

In Example 4-11, the particle size of the spherical particles was 1.1 folds of the coating amount of the heat-resistant lubricating layer 20, and the true specific gravity of the spherical particles was 1.36 folds of that of the binder. Further, the inorganic material had a perfect cleavage in one direction, and had a true specific gravity that was 2.64 folds of the true specific gravity of the binder.

Heat-Resistant Lubricating Layer Coating Solution 4-9

| | |
|---|---|
| Butyral resin (True specific gravity 1.1) | 22.4 parts |
| Melamine-formaldehyde condensate spherical particles (True specific gravity 1.5, Particle size 0.5 μm) | 0.1 parts |
| Mica (True specific gravity 2.9, Perfect cleavage in one direction) | 1.5 parts |
| Zinc stearate | 6.0 parts |
| MEK | 40.0 parts |
| Toluene | 30.0 parts |

Example 4-12

The heat-sensitive transfer recording medium 2 of Example 4-12 was obtained in a manner similar to that of Example 4-1, except that the heat-resistant lubricating layer 20 was formed using a heat-resistant lubricating layer coating solution 4-10 of the following composition.

In Example 4-12, the particle size of the spherical particles was 1.1 folds of the coating amount of the heat-resistant lubricating layer 20, and the true specific gravity of the spherical particles was 1.36 folds of that of the binder. Further, the inorganic material had a perfect cleavage in one direction, and had a true specific gravity that was 2.64 folds of the true specific gravity of the binder.

Heat-Resistant Lubricating Layer Coating Solution 4-10

| | |
|---|---|
| Butyral resin (True specific gravity 1.1) | 21.8 parts |
| Melamine-formaldehyde condensate spherical particles (True specific gravity 1.5, Particle size 0.5 μm) | 0.7 parts |
| Mica (True specific gravity 2.9, Perfect cleavage in one direction) | 1.5 parts |
| Zinc stearate | 6.0 parts |
| MEK | 40.0 parts |
| Toluene | 30.0 parts |

Example 4-13

The heat-sensitive transfer recording medium 2 of Example 4-13 was obtained in a manner similar to that of Example 4-1, except that the heat-resistant lubricating layer 20 was formed using a heat-resistant lubricating layer coating solution 4-11 of the following composition.

In Example 4-13, the particle size of the spherical particles was 1.1 folds of the coating amount of the heat-resistant lubricating layer 20, and the true specific gravity of the spherical particles was 1.36 folds of that of the binder. Further, the inorganic material had a perfect cleavage in one direction, and had a true specific gravity that was 2.64 folds of the true specific gravity of the binder.

Heat-Resistant Lubricating Layer Coating Solution 4-11

| | |
|---|---|
| Butyral resin (True specific gravity 1.1) | 23.2 parts |
| Melamine-formaldehyde condensate spherical particles (True specific gravity 1.5, Particle size 0.5 μm) | 0.3 parts |
| Mica (True specific gravity 2.9, Perfect cleavage in one direction) | 0.5 parts |
| Zinc stearate | 6.0 parts |
| MEK | 40.0 parts |
| Toluene | 30.0 parts |

Example 4-14

The heat-sensitive transfer recording medium 2 of Example 4-14 was obtained in a manner similar to that of Example 4-1, except that the heat-resistant lubricating layer 20 was formed using a heat-resistant lubricating layer coating solution 4-12 of the following composition.

In Example 4-14, the particle size of the spherical particles was 1.1 folds of the coating amount of the heat-resistant lubricating layer 20, and the true specific gravity of the spherical particles was 1.36 folds of that of the binder. Further, the inorganic material had a perfect cleavage in one direction, and had a true specific gravity that was 2.64 folds of the true specific gravity of the binder.

Heat-Resistant Lubricating Layer Coating Solution 4-12

| | |
|---|---|
| Butyral resin (True specific gravity 1.1) | 20.5 parts |
| Melamine-formaldehyde condensate spherical particles (True specific gravity 1.5, Particle size 0.5 μm) | 0.3 parts |
| Mica (True specific gravity 2.9, Perfect cleavage in one direction) | 3.2 parts |
| Zinc stearate | 6.0 parts |
| MEK | 40.0 parts |
| Toluene | 30.0 parts |

Comparative Example 4-1

The heat-sensitive transfer recording medium 2 of Comparative Example 4-1 was obtained in a manner similar to that of Example 4-1, except that the heat-resistant lubricating layer 20 was formed using a heat-resistant lubricating layer coating solution 4-13 of the following composition.

In Comparative Example 4-1, the particle size of the spherical particles was 1.8 folds of the coating amount of the heat-resistant lubricating layer 20, and the true specific gravity of the spherical particles was 1.3 folds of that of the binder. Further, the inorganic material had a perfect cleavage in one direction, and had a true specific gravity that was 2.3 folds of the true specific gravity of the binder.

Heat-Resistant Lubricating Layer Coating Solution 4-13

| | |
|---|---|
| Polystyrene resin (True specific gravity 1.0) | 22.2 parts |
| Silicone resin spherical particles (True specific gravity 1.3, Particle size 0.8 μm) | 0.3 parts |
| Cristobalite (True specific gravity 3.2, No cleavage) | 1.5 parts |
| Zinc stearate | 6.0 parts |
| MEK | 40.0 parts |
| Toluene | 30.0 parts |

Comparative Example 4-2

The heat-sensitive transfer recording medium 2 of Comparative Example 4-2 was obtained in a manner similar to that of Example 4-1, except that the heat-resistant lubricating layer 20 was formed using a heat-resistant lubricating layer coating solution 4-14 of the following composition.

In Comparative Example 4-2, the particle size of the spherical particles was 1.1 folds of the coating amount of the heat-resistant lubricating layer 20, and the true specific gravity of the spherical particles was 1.5 folds of that of the binder. Further, the inorganic material had a perfect cleavage in one direction, and had a true specific gravity that was 2.9 folds of the true specific gravity of the binder.

Heat-Resistant Lubricating Layer Coating Solution 4-14

| | |
|---|---|
| Polystyrene resin (True specific gravity 1.0) | 22.2 parts |
| Melamine-formaldehyde condensate spherical particles | 0.3 parts |
| (True specific gravity 1.5, Particle size 0.5 μm) | |
| Mica | 1.5 parts |
| (True specific gravity 2.9, Perfect cleavage in one direction) | |
| Zinc stearate | 6.0 parts |
| MEK | 40.0 parts |
| Toluene | 30.0 parts |

Comparative Example 4-3

The heat-sensitive transfer recording medium 2 of Comparative Example 4-3 was obtained in a manner similar to that of Example 4-1, except that the heat-resistant lubricating layer 20 was formed using a heat-resistant lubricating layer coating solution 4-15 of the following composition.

In Comparative Example 4-3, the particle size of the spherical particles was 1.8 folds of the coating amount of the heat-resistant lubricating layer 20, and the true specific gravity of the spherical particles was 1.18 folds of that of the binder. Further, the inorganic material had a perfect cleavage in one direction, and had a true specific gravity that was 2.0 folds of the true specific gravity of the binder.

Heat-Resistant Lubricating Layer Coating Solution 4-15

| | |
|---|---|
| Butyral resin (True specific gravity 1.1) | 22.2 parts |
| Silicone resin spherical particles | 0.3 parts |
| (True specific gravity 1.3, Particle size 0.8 μm) | |
| Graphite | 1.5 parts |
| (True specific gravity 2.2, Perfect cleavage in one direction) | |
| Zinc stearate | 6.0 parts |
| MEK | 40.0 parts |
| Toluene | 30.0 parts |

Comparative Example 4-4

The heat-sensitive transfer recording medium 2 of Comparative Example 4-4 was obtained in a manner similar to that of Example 4-1, except that the heat-resistant lubricating layer 20 was formed using a heat-resistant lubricating layer coating solution 4-16 of the following composition.

In Comparative Example 4-4, the particle size of the spherical particles was 1.8 folds of the coating amount of the heat-resistant lubricating layer 20, and the true specific gravity of the spherical particles was 1.3 folds of that of the binder. Further, the inorganic material had a perfect cleavage in one direction, and had a true specific gravity that was 3.2 folds of the true specific gravity of the binder.

Heat-Resistant Lubricating Layer Coating Solution 4-16

| | |
|---|---|
| Polystyrene resin (True specific gravity 1.0) | 22.2 parts |
| Silicone resin spherical particles | 0.3 parts |
| (True specific gravity 1.3, Particle size 0.8 μm) | |
| Chlorite | 1.5 parts |
| (True specific gravity 3.2, Perfect cleavage in one direction) | |
| Zinc stearate | 6.0 parts |
| MEK | 40.0 parts |
| Toluene | 30.0 parts |

Comparative Example 4-5

The heat-sensitive transfer recording medium 2 of Comparative Example 4-5 was obtained in a manner similar to that of Example 4-1, except that the heat-resistant lubricating layer coating solution 4-1 used in Example 4-1 was coated so that a dry coating amount was 0.25 g/m$^2$.

In Comparative Example 4-5, the particle size of the spherical particles was 2.2 folds of the coating amount of the heat-resistant lubricating layer 20, and the true specific gravity of the spherical particles was 1.36 folds of that of the binder. Further, the inorganic material had a perfect cleavage in one direction, and had a true specific gravity that was 2.64 folds of the true specific gravity of the binder.

Comparative Example 4-6

The heat-sensitive transfer recording medium 2 of Comparative Example 4-6 was obtained in a manner similar to that of Example 4-1, except that the heat-resistant lubricating layer coating solution 4-1 used in Example 4-1 was coated so that a dry coating amount was 1.7 g/m$^2$.

In Comparative Example 4-6, the particle size of the spherical particles was 0.3 folds of the coating amount of the heat-resistant lubricating layer 20, and the true specific gravity of the spherical particles was 1.36 folds of that of the binder. Further, the inorganic material had a perfect cleavage in one direction, and had a true specific gravity that was 2.64 folds of the true specific gravity of the binder.

(Evaluation)

Continuous printing was conducted using the heat-sensitive transfer recording media 2 of Examples 4-1 to 4-14 and Comparative Examples 4-1 to 4-6. The results of evaluation on the thermal heads and the printed matters after the continuous printing are described.

Evaluation Method

In an evaluation method used, the heat-sensitive transfer recording media 2 of Examples 4-1 to 4-14 and Comparative Examples 4-1 to 4-6 were each subjected to a 20-km transfer test at a speed of 8 inch/sec using a thermal simulator. The conditions of the thermal heads and the printed matters after the test were observed. Regarding each of the thermal heads, the presence/absence of stains was confirmed. Regarding each of the printed matters, the presence/absence of uneven printing in the printed matter induced by the wear of the thermal head was confirmed. The results are shown in Table 5. It should be noted that at a point of finishing 10-km transfer, an intermediate evaluation was made. Further, the thermal heads were not cleaned during the test.

TABLE 5

(TSG = true specific gravity)

| | TSG ratio: Inorganic material/Binder | TSG ratio: Spherical particles/Binder | Particle size of spherical particles/Thickness of heat-resistant lubricating layer | Percentage of spherical particles in heat-resistant lubricating layer (%) | Percentage of inorganic particles in heat-resistant lubricating layer (%) | 10-km printing | | 20-km printing | |
|---|---|---|---|---|---|---|---|---|---|
| | | | | | | Thermal head | Printed matter | Thermal head | Printed matter |
| Ex. 4-1 | 2.64 | 1.36 | 1.10 | 1.00 | 5.00 | ○ | ○ | ○ | ○ |
| Ex. 4-2 | 2.20 | 1.30 | 1.80 | 1.00 | 5.00 | ○ | ○ | ○ | ○ |
| Ex. 4-3 | 2.91 | 1.30 | 1.80 | 1.00 | 5.00 | ○ | ○ | ○ | ○ |
| Ex. 4-4 | 2.91 | 1.30 | 1.80 | 1.00 | 5.00 | ○ | ○ | Δ | ○ |
| Ex. 4-5 | 2.64 | 1.36 | 1.90 | 1.00 | 5.00 | ○ | ○ | ○ | ○ |
| Ex. 4-6 | 2.64 | 1.36 | 0.50 | 1.00 | 5.00 | ○ | ○ | ○ | ○ |
| Ex. 4-7 | 2.64 | 1.36 | 1.10 | 0.67 | 5.00 | ○ | ○ | ○ | ○ |
| Ex. 4-8 | 2.64 | 1.36 | 1.10 | 1.96 | 4.90 | ○ | ○ | ○ | ○ |
| Ex. 4-9 | 2.64 | 1.36 | 1.10 | 1.00 | 2.33 | ○ | ○ | ○ | ○ |
| Ex. 4-10 | 2.64 | 1.36 | 1.10 | 1.00 | 9.33 | ○ | ○ | ○ | ○ |
| Ex. 4-11 | 2.64 | 1.36 | 1.10 | 0.33 | 5.00 | ○ | ○ | ○ | Δ |
| Ex. 4-12 | 2.64 | 1.36 | 1.10 | 2.33 | 5.00 | ○ | ○ | Δ | ○ |
| Ex. 4-13 | 2.64 | 1.36 | 1.10 | 1.00 | 1.67 | ○ | ○ | Δ | ○ |
| Ex. 4-14 | 2.64 | 1.36 | 1.10 | 1.00 | 10.67 | ○ | ○ | ○ | Δ |
| Con. Ex. 4-1 | 2.30 | 1.30 | 1.80 | 1.00 | 5.00 | Δ | Δ | X | X |
| Con. Ex. 4-2 | 2.90 | 1.50 | 1.10 | 1.00 | 5.00 | ○ | ○ | ○ | X |
| Con. Ex. 4-3 | 2.00 | 1.18 | 1.80 | 1.00 | 5.00 | ○ | ○ | ○ | X |
| Con. Ex. 4-4 | 3.20 | 1.30 | 1.80 | 1.00 | 5.00 | ○ | ○ | X | ○ |
| Con. Ex. 4-5 | 2.64 | 1.36 | 2.20 | 1.00 | 5.00 | ○ | ○ | ○ | X |
| Con. Ex. 4-6 | 2.64 | 1.36 | 0.30 | 1.00 | 5.00 | ○ | ○ | X | ○ |

Evaluation on Thermal Head

Each thermal head was evaluated, with "○" indicating that no attachment of stain to thermal head was observed, with "Δ" indicating that stains were slightly attached to thermal head, and with "X" indicating that stains were apparently attached to thermal head.

Evaluation on Printed Matter

Each printed matter was evaluated, with "○" indicating that the printed matter was in good condition with no unevenness, with "Δ" indicating that quite pale streaky unevenness was observed in the printed matter, and with "X" indicating that streaky unevenness was observed in the printed matter.

Evaluation Results

From the results shown in Table 5, it was confirmed that the heat-sensitive transfer recording media 2 of Examples 4-1 and 4-3 and 4-5 to 4-10 had neither attachment of stains to the thermal heads, nor unevenness in the printed matters ascribed to the wear of the thermal heads, after conducting 20-km printing, thus achieving good evaluation.

From the results of Example 4-1 and Comparative Example 4-1, it was confirmed that the inorganic material was required to have cleavage. In Comparative Example 4-1 using no inorganic material having cleavage, stains were slightly observed in the thermal head, and uneven printing due to the wear of the thermal head, although slightly, was observed in the printed matter, after conducting 10-km printing. Further, when printing was continued up to 20 km, apparently visible stains were observed in the thermal head, and uneven printing due to the wear of the thermal head was observed in the printed matter.

Further, from the results of Examples 4-1 to 4-3 and Comparative Examples 4-2 to 4-6, it was confirmed that, preferably: the true specific gravity of the inorganic material having cleavage was in a range of not less than about 2.1 folds to not more than about 3 folds of the true specific gravity of the binder; and the average particle size of the spherical particles was in a range of not less than about 0.4 folds to not more than about 2 folds of the thickness of the heat-resistant lubricating layer 20, and the true specific gravity was not more than about 1.4 folds of that of the binder.

Uneven printing attributed to the wear of the thermal head was observed in the printed matter at a printing point of 20 km in Comparative Example 4-2 in which the true specific gravity of the spherical particles exceeded 1.4 folds of the true specific gravity of the binder, Comparative Example 4-3 in which the true specific gravity of the inorganic material having cleavage was below 2 folds of the true specific gravity of the binder, and Comparative Example 4-5 in which the average particle size of the spherical particles exceeded 2 folds of the thickness of the heat-resistant lubricating layer 20. Further, apparently visual stains were observed in the thermal head at a printing point of 20 km in Comparative Example 4-3 in which the true specific gravity of the inorganic material having cleavage exceeded 3 folds of the true specific gravity of the binder, and Comparative Example 4-6 in which the average particle size of the spherical particles was below 0.4 folds of the thickness of the heat-resistant lubricating layer 20.

Further, from the results of Examples 4-7, 4-8 and 4-12, it was confirmed that the spherical particles in the heat-resistant lubricating layer was desirably in a range of not less than about 0.5 mass % to not more than about 2 mass %.

In Example 4-11 in which the content of the spherical particles was lower than 5 mass %, uneven printing attributed to the wear of the thermal head was observed, although slightly, in the printed matter at a printing point of 20 km. Further, in Example 4-12 in which the content of the spherical particles was more than 2 mass %, a stains were slightly observed in the thermal head at a printing point of 20 km.

Also, from the results of Examples 4-9, 4-10, 4-13 and 4-14, it was confirmed that the content of the inorganic material having cleavage in the heat-resistant lubricating layer 20 was desirably in a range of not less than about 2 mass % to not more than about 10 mass %.

In Example 4-13 in which the content of the inorganic material having cleavage was lower than 2 mass %, stains were slightly observed in the thermal head at a printing point of 20 km. Further, in Example 4-14 in which the content of the inorganic material having cleavage was more than 10 mass %, uneven printing attributed to the wear of the thermal head was observed, although slightly, in the printed matter at a printing point of 20 km.

Furthermore, from the results of Examples 4-1 and 4-4, it was confirmed that, desirably, the inorganic material had perfect cleavage in one direction.

In Example 4-4 in which the inorganic material had perfect cleavage in four directions, stains were slightly observed in the thermal head at a printing point of 20 km.

As described above, the present embodiment can provide the heat-sensitive transfer recording medium 2 having the heat-resistant lubricating layer 20 that can be applied to a high-speed printer which tends to be adversely affected by the occurrence of uneven thermal conduction due to the wear of the thermal head. Specifically, in the case where high-speed printing is conducted by a high-speed printer of sublimation transfer type with an increase of energy applied to the thermal head and in the case where the high-speed printer has a self-cleaning function and thus is maintenance free and the running distance of the thermal head is long, the heat-sensitive transfer recording medium 2 is able to reduce the load imposed on the thermal head and suppress the uneven thermal conduction.

Fifth Embodiment

Besides the problems discussed above, the technical field related to the present invention has been facing still another problem of deteriorating the transfer properties, such as release stability and foil-off resistance, of a protective layer in a heat-sensitive transfer recording medium when used in a high-speed printer, due to the uneven thermal conduction of the thermal head. Other than the above performances, the protective layer is required to balance durability with glossiness. Durability of the protective layer includes abrasion resistance, plasticizer resistance, solvent resistance, and the like.

In order that all of these performances are constantly possessed by the protective layer, some methods have been proposed. For example, in a proposal, a layer that contains an acrylic resin as a major component and a layer that contains a polyester resin as a major component are successively stacked, as a heat transferable protective layer, on a base (see JP-A-2002-240404).

Another proposal provides a heat-sensitive transfer recording medium having a heat transferable protective layer in which at least a release layer and an adhesive layer are stacked from the base side. In the protective layer, the release layer contains a copolymer of at least two or more components out of methyl methacrylate, methacrylamide, and methacryl acid, while the adhesive layer contains one from a group of three components which are methyl methacrylate, butyl methacrylate, and a copolymer of methyl methacrylate and butyl methacrylate, or contains a mixture of at least one from this group and a ketone resin (see JP-A-2003-080844).

Another proposal provides a heat-sensitive transfer recording medium having a heat transferable protective layer in which a release layer is formed on a base-side interface. The release layer is made of a resin composition that contains a combination of an acrylic resin and a styrene acrylic resin. The resin composition contains the acrylic resin by 30 to 60 wt % and the styrene acrylic resin by 40 to 70 wt % relative to the entire volume of the composition (see JP-A-2012-035488).

However, in the heat-sensitive transfer recording medium proposed in JP-A-2002-240404, abrasion resistance is not enhanced to a sufficient level, although there is no problem in the plasticizer resistance and the solvent resistance. In addition, foil-off resistance is insufficient as well. On the other hand, in the heat-sensitive transfer recording medium proposed in JP-A-2003-080844, abrasion resistance is not enhance to a sufficient level, although no problem is found in the foil-off resistance. Further, in the heat-sensitive transfer recording medium proposed in JP-A-2012-035488, plasticizer resistance is extremely bad and abrasion resistance is not enhance to a sufficient level, although glossiness is high.

In this way, a heat-sensitive transfer recording medium is yet to be developed, which satisfies all of release stability and foil-off resistance, durability including abrasion resistance and plasticizer resistance, and glossiness, when the recording medium is used in a high-speed printer.

A fifth embodiment of the present invention can solve the problems set forth above.

Hereinafter is described a fifth embodiment of the heat-sensitive transfer recording medium related to the present invention.

(General Configuration)

Figure 3:
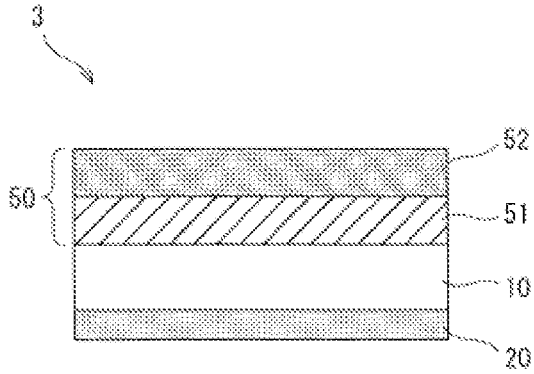
FIG. 3 is a diagram illustrating a schematic configuration of a heat-sensitive transfer recording medium of a fifth embodiment of the present invention.

FIG. 3 is a diagram illustrating a schematic configuration of the heat-sensitive transfer recording medium of the present embodiment as viewed from a lateral side.

As shown in FIG. 3, a heat-sensitive transfer recording medium 3 has a configuration that includes a base 10, a heat-resistant lubricating layer 20 formed on one surface of the base 10 to impart lubricity relative to a thermal head, and a heat transferable protective layer 50 formed on the other surface of the base 10 by successively stacking a release layer 51 and an adhesive layer 52.

It should be noted that, in the base 10, adhesion treatment may be given to either one or both of the surfaces on which the heat-resistant lubricating layer 30 and the heat transferable protective layer 20 are formed. As the adhesion treatment, a known technique may be used, such as corona treatment, flame treatment, ozone treatment, ultraviolet treatment, radiation treatment, rough surface treatment, plasma treatment or primer treatment. These treatments may be used in combination of two or more.

The base 10 and the heat-resistant lubricating layer 20 included in the heat-sensitive transfer recording medium 3 related to the present embodiment have configurations similar to those of the base 10 and the heat-resistant lubricating layer 20 described in the first embodiment. Accordingly, description herein is focused on the heat transferable protective layer 50, release layer 51 and the adhesion layer 52 alone, and description on the rest is omitted.

(Configuration of Heat Transferable Protective Layer 50)

It is essential that the heat transferrable protective layer 50 is provided with the release layer 51 that turns to an outermost layer after transfer to an object to be transferred. Specifically, the heat-sensitive transfer recording medium shown in FIG. 3 has the heat transferable protective layer 50 on at least a part of the base. The release layer 51, which turns to the outermost layer after transfer of the heat transferable protective layer 50, contains a polymethylmethacrylate resin by not less than about 95% in terms of solid weight ratio, inorganic fine particles by not less than about 1.0% in terms of solid weight ratio, which have an average particle size of not more than about 100 nm, a refractive index of not less than about 1.4 but not more than about 1.6 and a Mohs hardness of not less than about 4, and a polyether-modified silicone oil by not less than about 5% in terms of solid weight ratio.

(Configuration of Release Layer 51)

It is essential that the release layer 51 contains a polymethylmethacrylate resin by not less than about 95% in terms of solid weight ratio. The presence of the polymethylmethacrylate resin in the outermost surface of the object to be transferred can not only exert high glossiness owing to the transparency, but also impart plasticizer resistance and solvent resistance. If the solid weight ratio of the polymethylmethacrylate resin in the release layer 51 is less than 95%, sufficient plasticizer resistance or solvent resistance cannot be obtained.

The release layer 51 may contain a binder other than the polymethylmethacrylate resin. As an example, mention may be made of: styrene series resins, such as polystyrene, and poly α-methylstyrene; acryl series resins, such as polyacrylic ethyl; vinyl series resins, such as polyvinyl chloride, polyvinyl acetate, vinyl chloride-vinyl acetate copolymer, polyvinyl butyral, and polyvinyl acetal; synthetic resins, such as polyester resin, polyamide resin, epoxy resin, polyurethane resin, petroleum resin, ionomer, ethylene-acrylic acid copolymer, and ethylene-acrylic ester copolymer; cellulose derivatives, such as cellulose nitrate, ethyl cellulose, and cellulose acetate propionate; natural resins and derivatives of synthetic rubber, such as rosin, rosin-modified maleic resin, ester gum, polyisobutylene rubber, butyl rubber, styrene-butadiene rubber, butadiene-acrylonitrile rubber, and polychlorinated olefin; waxes, such as, carnauba wax, and paraffin wax. However, preferably, the release layer 51 is formed of an acryl series resin from a viewpoint of abrasion resistance, plasticizer resistance and glossiness, and more preferably formed of a polymethylmethacrylate resin alone.

It is essential that the release layer 51 contains inorganic fine particles by not less than about 1.0% in terms of solid weight ratio, with an average particle size of not more than about 100 nm, a refractive index of not less than about 1.4 but not more than about 1.6 and a Mohs hardness of not less than about 4. If the average particle size of the inorganic fine particles exceeds 100 nm, the surface of a printed matter after transfer becomes rough and thus glossiness is impaired. Further, when the refractive index is less than 1.4 or exceeds 1.6 as well, the transparency is impaired due to the difference in refractive index 1.49 of the polymethylmethacrylate resin, leading to lowering of glossiness. Further, when the Mohs hardness is less than 4, sufficient abrasion resistance is not obtained. Also, if the solid weight ratio of the inorganic fine particles in the release layer 51 is less than 1.0%, effect of improving abrasion resistance is not exerted at all.

As the inorganic fine particles that can be added to the release layer 51, mention is made of anhydrous silica, magnesium carbonate, wollastonite, fluorite, or the like. Among them, anhydrous silica is preferable, which is comparatively hard with a Mohs hardness of 7 and has a refractive index of 1.45 which is approximate to that of the polymethylmethacrylate resin.

Further, it is essential that the release layer 51 contains polyether-modified silicone oil by not less than about 0.5% in terms of solid weight ratio. The inorganic fine particles mentioned above, even when used singly, can improve abrasion resistance, but when combined with polyether-modified silicone oil, the abrasion resistance is further improved and reaches a level of good satisfaction. Although the synergistic effect of the inorganic fine particles and polyether-modified silicone oil is not known exactly, use of these components is considered to impart adequate lubricity to the surface, while forming a core-shell structure inside the layer, and optimally stabilize the inorganic fine particles and the resin to thereby create a factor of improving abrasion resistance.

Further, preferably, the thickness of the release layer 51 is in a range of not less than about 0.5 μm but not more than about 1.5 μm. If the thickness is less than 0.5 μm, plasticizer resistance may be lowered or heat resistance may become insufficient and thus glossiness may be lowered. If the thickness exceeds 1.5 foil-off resistance is impaired, and besides, release becomes unstable and thus there is a concern of occurring abnormal transfer.

In addition, it is preferable that the polyether-modified silicone oil with a 100% solid content has a kinetic viscosity of not less than about 200 $mm^2/s$ at 25° C. If the kinetic viscosity of the polyether-modified silicone oil is less than 200 $mm^2/s$, sufficient foil-off resistance is not obtained and hence the protective layer is peeled off up to an energy-non-imposed portion which should not originally be peeled off.

(Configuration of Adhesive Layer 52)

With the addition of functional additives, the heat transferable protective layer 50 is not only imparted with light resistance and weather resistance, but also adjusted in the release stability and the lubricity of the protective layer surface. The functional additives include not only release agents, waxes and lubricants, but also ultraviolet absorbers, light stabilizers, antioxidizing agents, fluorescent brighteners, and antistatic agents. However, addition of the functional agents to the release layer 51 may impair, for example, abrasion resistance and plasticizer resistance. Therefore, it is preferable that a plurality of layers of more than two are stacked, and the additives are added such as to the adhesive layer 52 located, after transfer, between the object to be transferred and the release layer 51. In other words, it is preferable that, in the heat-sensitive transfer recording medium 3 shown in FIG. 3, the heat transferable protective layer 50 formed on at least a part of the base 10 is formed of a plurality of layers of more than two.

Examples of the functional additives used in the adhesive layer 52 include particles represented by: inorganic fillers, such as calcium carbonate, kaolin, talc, silicone powder, calcium sulfate, barium sulfate, titanium dioxide, zinc oxide, satin white, zinc carbonate, magnesium carbonate, aluminum silicate, calcium silicate, magnesium silicate, silica, colloidal silica, colloidal alumina, pseudoboehmite, aluminum hydroxide, alumina, lithopone, zeolite, hydrous halloysite, and magnesium hydroxide; and organic fillers, such as acryl series plastic pigment, styrene series plastic pigment, micro capsule, urea resin, and melamine resin. Among them, silicone powder is preferable, which is in a truly spherical shape and thus is able to uniformly adjust the lubricity of the protective layer surface. Examples of the functional additives used in the adhesive layer 52 further include: ultraviolet absorbers represented by benzophenone, benzotriazole, benzoate, and triazine series; light stabilizers represented by hindered amine series; antioxidizing agents represented by hindered phenol series; fluorescent brighteners; and antistatic agents.

The ultraviolet absorbers contained in the adhesive layer 52 include benzophenone series, benzotriazole series, benzoate series, and triazine series. These may be used singly or used by blending a plurality of them. Preferably, the addition amount is 1 to 20 parts by weight relative to 100 parts by weight of binder. If the addition amount is less than 1 part by weight, sufficient ultraviolet absorption performance is not necessarily exerted. On the other hand, if the addition amount is not less than about 20 parts by weight, the agents may bleed out to the surface of the printed matter and thus no weather resistance that can endure long storage can be ensured.

Further, the functional additives contained in the adhesive layer 52 include, for example: release agents represented by silicon oils, such as straight silicone, and modified silicone, surfactants having a fluoroalkyl group or a perfluoroalkyl group, and phosphate ester series; and lubricants represented by waxes, such as carnauba wax, paraffin wax, polyethylene wax, and rice wax, and organic or inorganic fillers.

As necessary, other agents may be added, including: light stabilizers such as of hindered amine series, and Ni chelate series; heat stabilizers such as of hindered phenol series, sulfur series, and mold resin series; flame regardants such as of aluminum hydroxide, and magnesium hydroxide; antioxidizing agents such as of phenol series, and sulfur series; antiblocking agents; catalyst accelerators; colorants that can ensure transparency; gloss modifiers; fluorescent brighteners; and antistatic agents.

The binder used in the adhesive layer 52 is not particularly limited, but for having heat fusibility. As example, mention is made of: styrene series resins, such as polystyrene, and poly α-methylstyrene; acryl series resins, such as polymethylmethacrylate, and polyacrylic ethyl; vinyl series resins, such as polyvinyl chloride, polyvinyl acetate, vinyl chloride-vinyl acetate copolymer, polyvinyl butyral, and polyvinyl acetal; synthetic resins, such as polyester resin, polyamide resin, epoxy resin, polyurethane resin, petroleum resin, ionomer, ethylene-acrylic acid copolymer, and ethylene-acrylic ester copolymer; cellulose derivatives, such as cellulose nitrate, ethyl cellulose, and cellulose acetate propionate; and natural resins and derivatives of synthetic rubber, such as rosin, rosin-modified maleic resin, ester gum, polyisobutylene rubber, butyl rubber, styrene-butadiene rubber, butadiene-acrylonitrile rubber, and polychlorinated olefin; and waxes, such as, carnauba wax, and paraffin wax. However, similar to the release layer 51, it is preferable that the binder is formed of an acryl series resin from a viewpoint of abrasion resistance, plasticizer resistance and glossiness.

It should be noted that the heat-resistant lubricating layer 20 can be formed by coating and drying by means of a known method. As an example of the coating method, mention may be made of gravure coating, screen printing, spray coating and reverse roll coating.

Example 5

Referring to FIG. 3, hereinafter are described some examples of manufacture of the heat-sensitive transfer recording medium 3 described in the fifth embodiment, and some comparative examples. The present invention should not be construed as being limited to the following examples.

First, the materials used for the heat-sensitive transfer recording media of the respective examples of the present invention and of the respective comparative examples are shown. It should be noted that the term "parts" in the following description refers to a mass standard as far as no particular mention is made.

(Preparation of Base Having Heat-Resistant Lubricating Layer)

A polyethylene terephthalate film having a thickness of 4.5 μm, whose one surface was easy-adhesion-treated, was used as the base 10. A heat-resistant lubricating layer coating solution 5-1 having the following composition was coated onto a non-easy-adhesion-treated surface of the film by means of gravure coating so that a dry coating amount was 0.5 g/m$^2$. Then, the heat-resistant lubricating layer coating solution 5-1 coated onto the non-easy-adhesion-treated surface of the base 10 was dried at 100° C. for one minute, thereby preparing a heat-resistant lubricating layer.

Heat-Resistant Lubricating Layer Coating Solution 5-1

| | |
|---|---|
| Silicon acrylate (US-350 of Toagosei Co., Ltd.) | 50.0 parts |
| MEK | 50.0 parts |

Example 5-1

Preferably, in the heat-sensitive transfer recording medium related to the present embodiment, the release layer 51 that turns to the outermost layer after transfer of the heat transferable protective layer 50 has a dry coating thickness ranging from not less than about 0.5 μm to not more than about 1.5 μm. Experimental results that are the grounds of these values are shown below.

A release layer coating solution 5-1 having the following composition was coated onto the easy-adhesion-treated surface of the heat-resistant lubricating layer by means of gravure coating so that a dry thickness was 1.0 μm, followed by drying at 100° C. for two minutes, thereby forming the release layer 51. Subsequently, an adhesive layer coating solution 5-1 having the following composition was coated onto the release layer 51 by means of gravure coating so that a dry thickness was 1.0 μm, followed by drying at 100° C. for two minutes, thereby forming the adhesive layer 52. Thus, the heat-sensitive transfer recording medium 3 of Example 5-1 was obtained.

Release Layer Coating Solution 5-1

| | |
|---|---|
| Polymethylmethacrylate | 9.50 parts |
| Anhydrous silica (Average particle size: 20 μm) | 0.35 parts |
| Polyether-modified silicone oil (Kinetic viscosity: 200 mm$^2$/s) | 0.15 parts |
| Toluene | 40.0 parts |
| Methyl ethyl ketone | 60.0 parts |

Adhesive Layer Coating Solution 5-1

| | |
|---|---|
| Polyethylmethacrylate | 10.0 parts |
| Methyl ethyl ketone | 90.0 parts |

Example 5-2

The heat-sensitive transfer recording medium 3 of Example 5-2 was obtained in a manner similar to that of Example 5-1, except that the release layer 21 was formed by coating a release layer coating solution 5-2 having the following composition, in the heat-sensitive transfer recording medium 3 prepared in Example 5-1.

Release Layer Coating Solution 5-2

| | |
|---|---|
| Polymethylmethacrylate | 9.85 parts |
| Anhydrous silica (Average particle size: 100 μm) | 0.10 parts |
| Polyether-modified silicone oil (Kinetic viscosity: 200 mm$^2$/s) | 0.05 parts |

-continued

| | |
|---|---|
| Toluene | 40.0 parts |
| Methyl ethyl ketone | 60.0 parts |

Example 5-3

The heat-sensitive transfer recording medium 3 of Example 5-3 was obtained in a manner similar to that of Example 5-1, except that the adhesive layer 22 was not coated, in the heat-sensitive transfer recording medium 3 prepared in Example 5-1.

Example 5-4

The heat-sensitive transfer recording medium 3 of Example 5-4 was obtained in a manner similar to that of Example 5-1, except that the release layer 21 was formed by coating a release layer coating solution 5-3 having the following composition, in the heat-sensitive transfer recording medium 3 prepared in Example 5-1.

Release Layer Coating Solution 5-3

| | |
|---|---|
| Polymethylmethacrylate | 9.50 parts |
| Magnesium carbonate (Average particle size: 100 μm) | 0.35 parts |
| Polyether-modified silicone oil (Kinetic viscosity: 200 $mm^2/s$) | 0.15 parts |
| Toluene | 40.0 parts |
| Methyl ethyl ketone | 60.0 parts |

Example 5-5

The heat-sensitive transfer recording medium 3 of Example 5-5 was obtained in a manner similar to that of Example 5-1, except that the release layer 21 was formed by coating a release layer coating solution 5-4 having the following composition, in the heat-sensitive transfer recording medium 3 prepared in Example 5-1.

Release Layer Coating Solution 5-4

| | |
|---|---|
| Polymethylmethacrylate | 9.50 parts |
| Anhydrous silica (Average particle size: 20 μm) | 0.35 parts |
| Polyether-modified silicone oil (Kinetic viscosity: 130 $mm^2/s$) | 0.15 parts |
| Toluene | 40.0 parts |
| Methyl ethyl ketone | 60.0 parts |

Example 5-6

The heat-sensitive transfer recording medium 3 of Example 5-6 was obtained in a manner similar to that of Example 5-1, except that the release layer 21 was ensured to have a dry thickness of 0.3 μm, in the heat-sensitive transfer recording medium 3 prepared in Example 5-1.

Example 5-7

The heat-sensitive transfer recording medium 3 of Example 5-7 was obtained in a manner similar to that of Example 5-1, except that the release layer 21 was ensured to have a dry thickness of 1.7 μm, in the heat-sensitive transfer recording medium 3 prepared in Example 5-1.

Comparative Example 5-1

The heat-sensitive transfer recording medium 3 of Comparative Example 5-1 was obtained in a manner similar to that of Example 5-1, except that the release layer 51 was formed by coating a release layer coating solution 5-5 having the following composition, in the heat-sensitive transfer recording medium 3 prepared in Example 5-1.

Release Layer Coating Solution 5-5

| | |
|---|---|
| Polymethylmethacrylate | 9.00 parts |
| Polyester resin | 0.50 parts |
| Anhydrous silica (Average particle size: 20 μm) | 0.35 parts |
| Polyether-modified silicone oil (Kinetic viscosity: 200 $mm^2/s$) | 0.15 parts |
| Toluene | 40.0 parts |
| Methyl ethyl ketone | 60.0 parts |

Comparative Example 5-2

The heat-sensitive transfer recording medium 3 of Comparative Example 5-2 was obtained in a manner similar to that of Example 5-1, except that the release layer 51 was formed by coating a release layer coating solution 5-6 having the following composition, in the heat-sensitive transfer recording medium 3 prepared in Example 5-1.

Release Layer Coating Solution 5-6

| | |
|---|---|
| Polymethylmethacrylate | 9.50 parts |
| Alumina (Average particle size: 20 μm) | 0.35 parts |
| Polyether-modified silicone oil (Kinetic viscosity: 200 $mm^2/s$) | 0.15 parts |
| Toluene | 40.0 parts |
| Methyl ethyl ketone | 60.0 parts |

Comparative Example 5-3

The heat-sensitive transfer recording medium 3 of Comparative Example 5-3 was obtained in a manner similar to that of Example 5-1, except that the release layer 51 was formed by coating a release layer coating solution 5-7 having the following composition, in the heat-sensitive transfer recording medium 3 prepared in Example 5-1.

Release Layer Coating Solution 5-7

| | |
|---|---|
| Polymethylmethacrylate | 9.50 parts |
| Mica (Average particle size: 20 μm) | 0.35 parts |
| Polyether-modified silicone oil (Kinetic viscosity: 200 $mm^2/s$) | 0.15 parts |
| Toluene | 40.0 parts |
| Methyl ethyl ketone | 60.0 parts |

Comparative Example 5-4

The heat-sensitive transfer recording medium 3 of Comparative Example 5-4 was obtained in a manner similar to that of Example 5-1, except that the release layer 51 was formed by coating a release layer coating solution 5-8 having the following composition, in the heat-sensitive transfer recording medium 3 prepared in Example 5-1.

Release Layer Coating Solution 5-8

| | |
|---|---|
| Polymethylmethacrylate | 9.85 parts |
| Polyether-modified silicone oil (Kinetic viscosity: 200 $mm^2/s$) | 0.15 parts |
| Toluene | 40.0 parts |
| Methyl ethyl ketone | 60.0 parts |

Comparative Example 5-5

The heat-sensitive transfer recording medium 3 of Comparative Example 5-5 was obtained in a manner similar to that of Example 5-1, except that the release layer 51 was formed by coating a release layer coating solution 5-9 having the following composition, in the heat-sensitive transfer recording medium 3 prepared in Example 5-1.

Release Layer Coating Solution 5-9

| | |
|---|---|
| Polymethylmethacrylate | 9.65 parts |
| Anhydrous silica (Average particle size: 20 μm) | 0.35 parts |
| Toluene | 40.0 parts |
| Methyl ethyl ketone | 60.0 parts |

Comparative Example 5-6

The heat-sensitive transfer recording medium 3 of Comparative Example 5-6 was obtained in a manner similar to that of Example 5-5, except that the release layer 51 was formed by coating a release layer coating solution 5-10 having the following composition, in the heat-sensitive transfer recording medium 3 prepared in Example 5-1.

Release Layer Coating Solution 5-10

| | |
|---|---|
| Polymethylmethacrylate | 9.50 parts |
| Anhydrous silica (Average particle size: 20 μm) | 0.35 parts |
| Polyether-modified silicone oil (Kinetic viscosity: 200 $mm^2/s$) | 0.15 parts |
| Toluene | 40.0 parts |
| Methyl ethyl ketone | 60.0 parts |

(Preparation of Object to be Transferred)

A white-foam polyethylene terephthalate film of 188 μm was used as the base 10 to prepare an object to be transferred for heat-sensitive transfer by coating an image-receiving layer coating solution of the following composition onto one surface of the film by means of gravure coating so that a dry coating amount was 5.0 $g/m^2$, followed by drying.

Image-Receiving Layer Coating Solution

| | |
|---|---|
| Vinyl chloride-vinyl acetate-vinyl alcohol copolymer | 19.5 parts |
| Amino-modified silicone oil | 0.5 parts |
| Toluene | 40.0 parts |
| Methyl ethyl ketone | 40.0 parts |

(Evaluation on Printing)

The heat transferable protective layers 3 of Examples 5-1 to 5-7 and Comparative Examples 5-1 to 5-6 were each transferred onto a black solid-printed image-receiving layer by means of an evaluation thermal printer.

<Abrasion Resistance Test>

A cotton cloth of Kanakin No. 3 was mounted to a Gakushin testing machine and permitted to make 100 reciprocating motions on the surface of each printed matter, with an imposition of a load of 500 g. Evaluation was made on the basis of the following criteria. The results are shown in Table 6.

⊕: No change observed in the protective layer
○: Scratches observed only slightly in the protective layer
Δ: Scratches observed in the protective layer
ΔX: Adhesion of dye onto the cotton cloth slightly observed
X: Adhesion of dye onto the cotton cloth observed It should be noted that Δ, ○ and ⊕ indicate a level of having no practical problem.

<Plasticizer Resistance Test>

An eraser manufactured by Tombow Pencil Col, Ltd. was placed on a surface of each obtained printed matter with the imposition of a load of 2 $kg/cm^2$. In this state, the printed matter was left in a 50° C.20% RH environment for two days. Evaluation was made on the basis of the following criteria. The results are shown in Table 6.

○: No decoloration observed
Δ: Decoloration observed slightly
X: Decoloration observed It should be noted that Δ, ○ and ⊕ indicate a level of having no practical problem.

<Glossiness>

Glossiness of each obtained printed matter was measured using a gloss meter STMS-701 manufactured by Shiro Industry Co. (measurement angle 60°). The results are shown in Table 6. It should be noted that 80% or more was determined to be high glossiness.

<Foil-Off Resistance>

Evaluation on foil-off resistance was made on the basis of the following criteria. The results are shown in Table 6.

○: No adhesion of the protective layer observed in an end portion of the printed matter
Δ: Adhesion of the protective layer observed slightly in an end portion of the printed matter
X: Adhesion of the protective layer observed in an end portion of the printed matter

TABLE 6

| | Release layer | | | | | | | |
|---|---|---|---|---|---|---|---|---|
| | Polymethylmethacrylate | Inorganic fine particles | | | | | Polyether-modified silicone oil | |
| | Add. amount [parts] | Selection | Add. amount [parts] | Av. particle size [nm] | Refractive index | Mohs hardness | Add. amount [parts] | Kinetic viscosity [$mm^2/s$] |
| Ex. 5-1 | 9.50 | Silica | 0.35 | 20 | 1.45 | 7 | 0.15 | 200 |
| Ex. 5-2 | 9.85 | Silica | 0.10 | 100 | 1.45 | 7 | 0.05 | 200 |

TABLE 6-continued

| | | | | | | | | |
|---|---|---|---|---|---|---|---|---|
| Ex. 5-3 | 9.50 | Silica | 0.35 | 20 | 1.45 | 7 | 0.15 | 200 |
| Ex. 5-4 | 9.50 | Mg carbonate | 0.35 | 100 | 1.52 | 4 | 0.15 | 200 |
| Ex. 5-5 | 9.50 | Silica | 0.35 | 20 | 1.45 | 7 | 0.15 | 130 |
| Ex. 5-6 | 9.50 | Silica | 0.35 | 20 | 1.45 | 7 | 0.15 | 200 |
| Ex. 5-7 | 9.50 | Silica | 0.35 | 20 | 1.45 | 7 | 0.15 | 200 |
| Com. Ex. 5-1 | 9.00 | Silica | 0.35 | 100 | 1.45 | 7 | 0.15 | 200 |
| Com. Ex. 5-2 | 9.50 | Alumina | 0.35 | 20 | 1.76 | 9 | 0.15 | 200 |
| Com. Ex. 5-3 | 9.50 | Mica | 0.35 | 100 | 1.58 | 2.8 | 0.15 | 200 |
| Com. Ex. 5-4 | 9.85 | Silica | 0.00 | 100 | 1.45 | 7 | 0.15 | 200 |
| Com. Ex. 5-5 | 9.65 | Silica | 0.35 | 100 | 1.45 | 7 | 0 | 200 |
| Com. Ex. 5-6 | 9.50 | Silica | 0.35 | 200 | 1.45 | 7 | 0.15 | 200 |

| | Release layer | | Evaluation | | | |
|---|---|---|---|---|---|---|
| | Thickness [μm] | Adhesive layer | Abrasion res. | Plasticizer res. | Glossiness [%] | Foil-off res. |
| Ex. 5-1 | 1.0 | Pr. | ⊕ | ○ | 84 | ○ |
| Ex. 5-2 | 1.0 | Pr. | ○ | ⊕ | 86 | ○ |
| Ex. 5-3 | 1.0 | Ab. | ⊕ | ○ | 80 | ○ |
| Ex. 5-4 | 1.0 | Pr | ○ | ○ | 83 | ○ |
| Ex. 5-5 | 1.0 | Pr. | ⊕ | ○ | 85 | Δ |
| Ex. 5-6 | 0.3 | Pr. | ○ | ○ | 80 | ○ |
| Ex. 5-7 | 1.7 | Pr. | ⊕ | ○ | 85 | Δ |
| Com. Ex. 5-1 | 1.0 | Pr. | Δ | X | 81 | ○ |
| Com. Ex. 5-2 | 1.0 | Pr. | ⊕ | ⊕ | 70 | ○ |
| Com. Ex. 5-3 | 1.0 | Pr. | ΔX | ○ | 85 | ○ |
| Com. Ex. 5-4 | 1.0 | Pr. | X | ⊕ | 86 | X |
| Com. Ex. 5-5 | 1.0 | Pr. | ΔX | ○ | 85 | ○ |
| Com. Ex. 5-6 | 0.3 | Pr. | X | ○ | 73 | ○ |

As shown in table 6, the heat-sensitive transfer recording media 3 in the examples each contain polymethylmethacrylate by not less than 95% in terms of resin solid ratio in the release layer 51 that turns to the outermost layer after transfer to an object to be transferred and exhibit a high glossiness of not less than 80%. In Example 5-2 that contained polymethylmethacrylate by a highest ratio of 98.5%, plasticizer resistance was confirmed to be particularly excellent as well.

On the other hand, regarding abrasion resistance, it was confirmed that Example 5-1 having a larger addition amount of inorganic fine particles and polyether-modified silicone oil was superior to Example 5-2.

Further, comparison of Example 5-1 and Example 5-4 using silica and magnesium carbonate, respectively, as inorganic fine particles, it was confirmed that higher hardness of the inorganic fine particles showed much better abrasion resistance.

In addition, Example 5-3 having release layer 51 alone without forming the adhesive layer 52, when compared with Example 5-1, was slightly inferior in plasticizer resistance and glossiness, although was at a level of causing no practical problem.

Further, foil-off resistance was confirmed to be slightly lowered in Example 5-5 that used polyether-modified silicone oil having a kinetic viscosity of 130 $mm^2/s$ at 25° C. with a solid content of 100%. From this, it was confirmed that a kinetic viscosity of not less than about 200 $mm^2/s$ was essential to polyether-modified silicone oil at 25° C. with a solid content of 100%.

In Example 5-6 in which the thickness of the release layer 51 was 0.3 μm, glossiness was slightly lowered, which was probably due to the insufficient heat resistance.

On the other hand, foil-off resistance was slightly lowered in Example 5-7 in which the thickness of the release layer 51 was 1.7 μm.

In this regard, a good result was obtained in Example 5-1 in which a dry thickness of the release layer 51 was 1.0 μm, while quality deterioration was observed in Example 5-6 where the thickness was 0.3 μm and Example 5-7 where the thickness was 1.7 μm. From this, it was confirmed that, in the heat-sensitive transfer recording medium 3 related to the present embodiment, the release layer 51 that turned to the outermost layer after transfer of the heat transferable protective layer 50 preferably had a dry coating thickness ranging from not less than about 0.5 μm to not more than about 1.5 μm.

Comparative Example 5-1, in which the content of polymethylmethacrylate in the release layer 51 was 90% in terms of solid ratio, was confirmed to suffer from deterioration in plasticizer resistance. From this, a content of polymethylmethacrylate by not less than about 95% was confirmed to be essential to the release layer 51.

In Comparative Example 5-2, in which alumina was used as inorganic fine particles, glossiness was confirmed to be drastically deteriorated due to the difference in refractive index from polymethylmethacrylate. Further, deterioration in adhesion resistance, which was probably due to low hardness, was observed in Comparative Example 5-3 using mica as inorganic fine particles. Comparative Example 5-4, which did not contain inorganic fine particles, was confirmed to suffer from drastic deterioration in abrasion resistance and deterioration in foil-off resistance. From the comparison of Comparative Examples 5-2 and 5-4 with other Examples 5-1 to 5-6, it was confirmed to be essential to the release layer 51 to contain inorganic fine particles by a solid weight ratio of not less than about 1.0, with a particle diameter of not more than about 100 nm, a refractive index of not less than about 1.4 but not more than about 1.6 and a Mohs hardness of not less than about 4.

On the other hand, abrasion resistance of Comparative Example 5-5 containing no polyether-modified silicone oil was better than that of Comparative Example 5-4, but was not at a level of practical use. From this, it was confirmed to be essential to the release layer 51 to contain polyether-modified silicone oil by a solid weight ratio of not less than about 0.5%. In contrast to these matters, the heat transferable protective layer 3 of each of the examples has excellent plasticizer resistance and thus, when used in combination with inorganic fine particles and polyether-modified silicone oil, is expected to exert synergistic effect. In Comparative Example 5-6 that used anhydrous silica having an average particle size of 200 nm to form the release layer 51 having a thickness of 0.3 μm, the particle size was substantially the same with the thickness. Thus, Comparative Example 5-6 was confirmed to suffer from drastic lowering in glossiness, which was probably due to the formation of unevenness in the surface of the object to be transferred after transfer. From this matter as well, it was confirmed to be essential to the release layer 51 to contain inorganic fine particles by a solid weight ratio of not less than about 1.0%, with an average particle size of not more than about 100 nm, a refractive index of not less than about 1.4 but not more than about 1.6 and a Mohs hardness of not less than about 4.

As described above, the heat-sensitive transfer recording medium 3 related to the present embodiment has the heat transferable protective layer 50 in at least a part on the base 10. The release layer that serves as an outermost layer after transfer of the heat transferable protective layer 50 contains: polymethylmethacrylate by not less than about 95% in terms of solid weight ratio; inorganic fine particles by not less than about 1.0% in terms of solid weight ratio, with an average particle size of not more than about 100 nm, a refractive index of not less than about 1.4 but not more than about 1.6, and a Mohs hardness of not less than about 4; and polyether-modified silicone oil by not less than about 0.5% in terms of solid weight ratio.

Further, preferably, the heat-sensitive transfer recording medium 3 related to the present embodiment satisfies the following requirements. Specifically, the heat transferable protective layer 50 should be formed of a plurality of layers of two or more. Inorganic fine particles should be anhydrous silica. Polyether-modified silicone oil with a solid content of 100% should have a kinetic viscosity of not less than about 200 $mm^2/s$ at 25° C. Further, the release layer 51 should have a dry coating thickness ranging from not less than about 0.5 μm to not more than about 1.5 μm.

The heat-sensitive transfer recording medium 3 related to the present embodiment that satisfies the requirements set forth above can realize a heat transferable protective layer which is able to impart abrasion resistance, plasticizer resistance and glossiness to the surface of an object to be transferred and is excellent in foil-off resistance as well, under the condition that high-speed printing is conducted using a high-speed printer of sublimation transfer type with the increase of energy applied to the thermal head of the printer.

INDUSTRIAL APPLICABILITY

The heat-sensitive transfer recording medium obtained by the present invention is usable in a sublimation transfer-type printer. The heat-sensitive transfer recording medium of the present invention enables easy full-color formation of various images in combination with a high-speed and sophisticated printer and thus can be widely used such as for self-prints of digital cameras, cards such as for identification, or output materials for amusement.

REFERENCE SIGNS LIST

1 Heat-sensitive transfer recording medium
2 Heat-sensitive transfer recording medium
3 Heat-sensitive transfer recording medium
10 Base
20 Heat-resistant lubricating layer
30 Underlying layer
40 Dye layer
50 Heat transferable protective layer
51 Release layer
52 Adhesive layer

What is claimed is:

1. A heat-sensitive transfer recording medium, characterized in that the medium comprises a heat transferable protective layer in at least a part on a base, and a release layer that turns to an outermost layer after transfer of the heat transferable protective layer, contains polymethylmethacrylate resin by not less than about 95% in terms of solid weight ratio, inorganic fine particles by not less than about 1.0% in terms of solid weight ratio, with an average particle size of not more than about 100 nm, a refractive index of not less than about 1.4 but not more than about 1.6 and a Mohs hardness of not less than about 4, and polyether-modified silicone oil by not less than about 0.5% in terms of solid weight ratio.

2. The heat-sensitive transfer recording medium of claim 1, wherein the heat transferable protective layer is formed of a plurality of layers of two or more.

3. The heat-sensitive transfer recording medium of claim 1, wherein the inorganic fine particles are anhydrous silica.

4. The heat-sensitive transfer recording medium of claim 1, wherein the polyether-modified silicone oil with a solid content of 100% has a kinetic viscosity of not less than about 200 $mm^2/s$ at 25° C.

5. The heat-sensitive transfer recording medium of claim 1, wherein the release layer that turns to an outermost layer after transfer of the heat transferable protective layer has a dry coating thickness in a range of not less than about 0.5 μm to not more than about 1.5 μm.

* * * * *